US010730088B2

(12) United States Patent
Goto et al.

(10) Patent No.: US 10,730,088 B2
(45) Date of Patent: Aug. 4, 2020

(54) METHOD FOR MANUFACTURING HOT-ROLLED STEEL SHEET, STEEL SHEET CUTTING LOCATION SETTING DEVICE, STEEL SHEET CUTTING LOCATION SETTING METHOD, AND STEEL SHEET MANUFACTURING METHOD

(71) Applicant: JFE STEEL CORPORATION, Tokyo (JP)

(72) Inventors: Hiroto Goto, Tokyo (JP); Naoki Nakata, Tokyo (JP); Yukio Kimura, Tokyo (JP); Masaru Miyake, Tokyo (JP); Satoshi Ueoka, Tokyo (JP); Nobuo Nishiura, Tokyo (JP); Sonomi Shirasaki, Tokyo (JP); Takaomi Kato, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 794 days.

(21) Appl. No.: 15/314,744

(22) PCT Filed: May 13, 2015

(86) PCT No.: PCT/JP2015/002428
§ 371 (c)(1),
(2) Date: Nov. 29, 2016

(87) PCT Pub. No.: WO2015/182051
PCT Pub. Date: Dec. 3, 2015

(65) Prior Publication Data

US 2017/0182534 A1 Jun. 29, 2017

(30) Foreign Application Priority Data

May 30, 2014 (JP) ..... 2014-112515
Mar. 19, 2015 (JP) ..... 2015-055614
Apr. 7, 2015 (JP) ..... 2015-078498

(51) Int. Cl.
*B21B 1/22* (2006.01)
*B21B 15/00* (2006.01)
(Continued)

(52) U.S. Cl.
CPC ..... *B21B 15/0007* (2013.01); *B21B 1/22* (2013.01); *B21B 1/26* (2013.01); *B21B 1/38* (2013.01);
(Continued)

(58) Field of Classification Search
CPC .. B21B 1/22; B21B 1/224; B21B 1/46; B21B 15/0007; B21B 2015/0014;
(Continued)

(56) References Cited

U.S. PATENT DOCUMENTS 4,497,192 A 2/1985 Reizig et al.
6,722,174 B1 4/2004 Nishii et al.

FOREIGN PATENT DOCUMENTS

CA 2285717 A1 * 4/2001 ..... B21B 1/026
CN 1 311 065 A 9/2001
(Continued)

OTHER PUBLICATIONS

Translation; WO2005049257 A1, Jun. 2005.*
(Continued)

*Primary Examiner* — Edward T Tolan
(74) *Attorney, Agent, or Firm* — Oliff PLC

(57) ABSTRACT

A method for manufacturing a hot-rolled steel sheet having a large thickness and a large width, a larger sheet width and a lower temperature can stably be cut at a cutting load equal to that of a conventional steel sheet having a usual sheet thickness, a usual sheet width and a usual temperature. In a rough rolling step, the steel sheet is formed so that the shortest length L (mm) from a concave portion bottom to a convex portion top of the fishtail shape satisfies Equation (1)
(Continued)

mentioned below, and an intermediate portion between the concave portion bottom and the convex portion top, defined as a desired cutting location, is cut:

$$(2X+30) \leq L \leq 300 \quad (1),$$

in which X is a maximum deviation (mm) of the cutting location of a crop cutting machine and $0 \leq X \leq 90$.

7 Claims, 9 Drawing Sheets

(51) Int. Cl.

| | |
|---|---|
| ***B21B 1/26*** | (2006.01) |
| ***B21B 1/38*** | (2006.01) |
| *B21B 38/00* | (2006.01) |
| *B21B 1/34* | (2006.01) |

(52) U.S. Cl.
CPC ..... *B21B 1/224* (2013.01); *B21B 1/34* (2013.01); *B21B 38/00* (2013.01); *B21B 38/006* (2013.01); *B21B 2001/225* (2013.01); *B21B 2015/0014* (2013.01); *B21B 2263/20* (2013.01)

(58) Field of Classification Search
CPC ..... B21B 2261/06; B21B 2263/20; B21B 2001/225; B21B 1/24; B21B 1/26
See application file for complete search history.

(56) References Cited

FOREIGN PATENT DOCUMENTS

| | | | | | |
|---|---|---|---|---|---|
| CN | 1 675 008 | A | | 9/2005 | |
| CN | 2016-84903 | U | | 12/2010 | |
| DE | 3 151 384 | A1 | | 7/1983 | |
| EP | 0084646 | A1 | | 8/1983 | |
| EP | 1020239 | A2 | * | 7/2000 | ..... B21B 15/0007 |
| JP | 52-109462 | A | * | 9/1977 | ..... B21B 1/224 |
| JP | S58-155124 | A | | 9/1983 | |
| JP | S62-173115 | A | | 7/1987 | |
| JP | 07-09245 | A | * | 1/1995 | ..... B21B 15/00 |
| JP | H07-9245 | A | | 1/1995 | |
| JP | H09-141301 | A | | 6/1997 | |
| JP | 2005-014041 | A | | 1/2005 | |
| JP | 2013-086192 | A | | 5/2013 | |
| WO | 2004/000476 | A1 | | 12/2003 | |
| WO | 2005049257 | A1 | * | 6/2005 | ..... B21B 15/0007 |

OTHER PUBLICATIONS

Translation; JP52-109462 A, Sep. 1977.*
Nov. 17, 2017 Office Action issued in Chinese Patent Application No. 201580028510.2.
Jul. 28, 2015 International Search Report issued in International Patent Application No. PCT/JP2015/002428.
Jul. 28, 2015 Written Opinion issued in International Patent Application No. PCT/JP2015/002428.
May 26, 2017 Search Report issued in European Patent Application No. 15800491.1.
Jul. 10, 2017 Office Action issued in Korean Patent Application No. 10-2016-7032714.

* cited by examiner

METHOD FOR MANUFACTURING HOT-ROLLED STEEL SHEET, STEEL SHEET CUTTING LOCATION SETTING DEVICE, STEEL SHEET CUTTING LOCATION SETTING METHOD, AND STEEL SHEET MANUFACTURING METHOD

TECHNICAL FIELD

The present invention relates to a method for manufacturing a hot-rolled steel sheet in which after end of a rough rolling step and before finish rolling, crop portions of a front end of a steel sheet in a conveying direction and a rear end thereof in the conveying direction are cut, and then a finish rolling step is performed, a steel sheet cutting location setting device to set a cutting location of the crop portion, a steel sheet cutting location setting method, and a steel sheet manufacturing method. More particularly, the present invention is suitable in decreasing a crop cutting load when a hot-rolled steel sheet having a large thickness and a large width is manufactured. Here, the large thickness and the large width indicate a sheet thickness of 20 to 30 mm and a sheet width of 1200 to 2100 mm, respectively.

BACKGROUND ART

In general, on a finish rolling machine inlet side of a line for manufacturing a hot-rolled steel sheet (hereinafter referred to also as a hot strip mill), there is performed cutting of unsteady deformed portions called crop portions formed at a front end and a rear end of a steel sheet (a sheet bar or an intermediate material) in a steel sheet conveying direction (which is also a rolling direction) in a rough rolling step to stabilize steel sheet conveyance (also referred to as sheet passing) during finish rolling. The front end of the steel sheet in the conveying direction and the rear end thereof in the conveying direction are deformed into various shapes by width reduction of a sizing press, width rolling of a width rolling machine, horizontal rolling of a rough rolling machine and the like. FIGS. 1A to 1D illustrate examples of an outline (a planar shape) of the crop portion when each of the front end and the rear end of the steel sheet in the conveying direction are seen from above. A shape of FIG. 1A is called a fishtail and a shape of FIG. 1B is called a tongue. In the tongue shape, a central portion of the steel sheet in a width direction projects in the conveying direction to both ends of the steel sheet in the width direction. In the fishtail shape, both the ends of the steel sheet in the width direction project in the conveying direction to the central portion thereof in the width direction.

In the present description, a portion A illustrated in FIG. 1A is a concave portion bottom of the fishtail shape and a portion B is a convex portion top of the fishtail shape. Furthermore, a length from the concave portion bottom (the portion A) to the convex portion top (the portion B) of the fishtail shape is also referred to as a fishtail length. Furthermore, in a case where the fishtail shape is asymmetrical and right and left fishtails have different lengths, the smaller length of the two lengths is defined as the fishtail length. Depending on conditions of the rough rolling step, the planar shape of the crop portion also becomes such an asymmetric shape as illustrated in FIG. 1C or FIG. 1D in which both sides of the steel sheet in the width direction are asymmetric to the center thereof in the width direction. When this crop portion of the asymmetrical shape in the width direction is formed at the front end or the rear end of the steel sheet in the conveying direction and the steel sheet is passed through the finish rolling machine, an unbalanced load would be generated in a finish rolling roller in the steel sheet width direction, and as a result, there is the possibility that the steel sheet meanders during the finish rolling.

Furthermore, at the front end of the steel sheet in the conveying direction, heat is released from four surfaces of a most distal surface in the conveying direction, an end surface in the width direction, an upper surface and a lower surface, a temperature of the front end therefore noticeably drops, and the temperature becomes lower than that of a steady portion. This front end of the steel sheet in the conveying direction at which the temperature is low has a large deformation resistance, and therefore becomes a cause for a biting defect in the finish rolling machine. Furthermore, at the rear end of the steel sheet in the conveying direction, heat is released from four surfaces of a most proximal surface in the conveying direction, the end surface in the width direction, the upper surface and the lower surface, a temperature of the rear end therefore noticeably drops, and the temperature becomes lower than that of the steady portion. This rear end of the steel sheet in the conveying direction at which the temperature is low also has a large deformation resistance, and during the finish rolling, squeezing of the steel sheet easily occurs. As described above, after end of the rough rolling step and before the finish rolling, there is performed cutting of the crop portions of the front end of the steel sheet in the conveying direction and the rear end thereof in the conveying direction. The cutting of the crop portions are performed with a crop cutting machine (also referred to as a crop shear). When the crop portions of the front end of the steel sheet in the conveying direction and the rear end thereof in the conveying direction are cut, there can be obtained effects such as prevention of the meandering of the steel sheet in the finish rolling, stabilization of the biting of the steel sheet and prevention of the squeezing of the steel sheet.

Furthermore, in the cutting of the crop portions of the front end of the steel sheet in the conveying direction and the rear end thereof in the conveying direction, a cutting load noticeably varies with a type of hot-rolled steel sheet (product) to be manufactured. In recent years, an increasingly demanded steel sheet for a line pipe material has also been manufactured in the line for manufacturing the hot-rolled steel sheet (the hot strip mill). In this manufacturing of the hot-rolled steel sheet for the line pipe material, the cutting load of the crop cutting machine in the cutting of the crop portions of the front end of the steel sheet in the conveying direction and the rear end thereof in the conveying direction remarkably increases as compared with conventional manufacturing of a usual hot-rolled steel sheet. For the line pipe material, there are required specifications of high strength and extra thickness from the viewpoint of highly efficient transport of crude oil, natural gas or the like. Furthermore, a pipeline is also laid in a seismic zone, and hence high tenacity is also required for the line pipe material. Consequently, in the case where the hot-rolled steel sheet for the line pipe material is manufactured in the line for manufacturing the hot-rolled steel sheet (the hot strip mill), there are points to consider as follows.

The first point is a sheet thickness of the steel sheet. In the conventional hot-rolled steel sheet in which the thickness of the finish-rolled sheet is from about 2 to 4 mm, the sheet thickness of the intermediate material (the sheet bar) prior to the finish rolling is from 30 to 50 mm. On the other hand, in the case of the hot-rolled steel sheet for the line pipe material for which the high tenacity is required, control rolling called TMCP (thermo-mechanical control process) is performed to miniaturize a crystal structure, thereby acquiring the tenacity of the steel sheet, and in this case, it is necessary to increase a reduction ratio in the finish rolling. A product sheet thickness required in the hot-rolled steel sheet for the line pipe material is 20 mm or more and 30 mm or less, and further, for the purpose of obtaining the tenacity required for the line pipe material, a cumulative reduction ratio in the finish rolling needs to be at least 60%. That is, to manufacture the hot-rolled steel sheet for the line pipe material which has a sheet thickness of 20 mm in the line for manufacturing the hot-rolled steel sheet, the steel sheet of the intermediate material having a sheet thickness of 50 mm or more has to be finish-rolled. However, in the existing line for manufacturing the hot-rolled steel sheet, there is assumed the intermediate material of the usual steel sheet in which the sheet thickness of is from 30 to 50 mm, and a cutting load upper limit value of the crop cutting machine is specified in conformity to the conventional intermediate material sheet thickness. Therefore, to manufacture the hot-rolled steel sheet for the line pipe material in the existing line for manufacturing the hot-rolled steel sheet, there is required a technology of cutting the crop portion of the intermediate material having a sheet thickness of 50 mm or more with the existing crop cutting machine.

The second point to consider which is important in manufacturing the hot-rolled steel sheet for the line pipe material in the line for manufacturing the hot-rolled steel sheet (the hot strip mill) is a sheet width of the steel sheet (the intermediate material). There is also a case where the line pipe material is manufactured as a spiral steel tube. In this case, decreasing of welded portions of the steel tube as much as possible is more advantageous in terms of strength, and hence the hot-rolled steel sheet having a larger width is required as the pipe material. In general, the sheet width required as the hot-rolled steel sheet for the line pipe material is 1200 mm or more and 2100 mm or less, and it is necessary to cut the crop portion of the intermediate material having a sheet width of 1200 mm or more with the crop cutting machine.

The third point to consider which is important in manufacturing the hot-rolled steel sheet for the line pipe material in the line for manufacturing the hot-rolled steel sheet (the hot strip mill) is a temperature of the steel sheet (the intermediate material). For the purpose of obtaining the hot-rolled steel sheet having the high tenacity, the finish rolling has to be performed at a temperature of a non-recrystallizing region. Consequently, it is necessary to perform finish rolling by setting a sheet thickness center temperature of the steel sheet to 930° C. or less from the front end in the conveying direction to the rear end in the conveying direction. Therefore, when the crop portions of the front end of the steel sheet in the conveying direction and the rear end thereof in the conveying direction are cut, the temperature of each crop portion at a cutting location is also in the vicinity of 930° C. and becomes lower than that a temperature (about 1000° C.) of the usual steel sheet. Therefore, in the hot-rolled steel sheet for the line pipe material (the intermediate material), a cutting resistance value is higher and the cutting load increases as compared with the conventional steel sheet.

When the above-mentioned points to consider are taken together, the hot-rolled steel sheet for the line pipe material manufactured in the line for manufacturing the hot-rolled steel sheet (the hot strip mill) has a larger sheet thickness, a larger sheet width and a lower temperature, and in the crop cutting machine, the cutting load larger than that of the conventional hot-rolled steel sheet is applied to the hot-rolled steel sheet. Furthermore, the specifications of the existing crop cutting machine are designed in accordance with the heretofore manufactured conventional hot-rolled steel sheet, and hence for the purpose of manufacturing the hot-rolled steel sheet for the line pipe material without any noticeable equipment modification such as reinforcement of the crop cutting machine, a technique of cutting the steel sheet into a sheet thickness of 50 mm or more and a sheet width of 1200 mm or more and at a temperature of 930° C. or less is required also in the specifications of the existing crop cutting machine.

Concerning the cutting of the crop portions of the front end of the steel sheet in the conveying direction and the rear end thereof in the conveying direction on the inlet side of the finish rolling machine, various technologies have been suggested from the viewpoints of sheet passing properties in the finish rolling machine and decrease of yield loss. For example, in Patent Literature 1 mentioned below, there has been suggested a method of predicting a shape of the crop portion of the finish-rolled steel sheet from a shape of the crop portion of each of the front end of the steel sheet (the intermediate material) in the conveying direction and the rear end thereof in the conveying direction, evaluating an appearance of the steel sheet as the product, judging presence/absence of the crop portion to be cut, and automatically adjusting a cutting length. In this method, there is included a case where the crop portion of the fishtail shape is cut. Further, according to this method, the steel sheet can be rolled without cutting the crop portions of the front end of the steel sheet in the conveying direction and the rear end thereof in the conveying direction, or even when the crop portions are cut, the cutting length may be a minimum length, and hence the yield improves. Furthermore, for example, in Patent Literature 2 mentioned below, there has been suggested a method of measuring, with a shape meter, the shape of each of the crop portions of the front end of the steel sheet (the intermediate material) before cut in the conveying direction and the rear end thereof in the conveying direction, determining an optimum cutting length from the measured shape in consideration of the biting defect of the finish rolling machine, a quality and the yield, and cutting each crop portion into the cutting length. According to this method, sheet passing troubles decrease and the quality and yield improve.

CITATION LIST

Patent Literature

PTL 1: JP S62-173115 A
PTL 2: JP H07-009245 A

SUMMARY OF INVENTION

Technical Problem

According to a crop cutting method described in Patent Literature 1, there is a case where finish rolling is performed without cutting any crop portions, but in this case, a hot-rolled steel sheet can be manufactured without being restricted by a cutting load upper limit value of a crop cutting machine. However, the presence/absence of the crop portion to be cut depends on a shape of each of the crop portions of a front end of a steel sheet (an intermediate material) in a conveying direction and a rear end thereof in the conveying direction, and hence all the steel sheets (the intermediate materials) cannot be passed through the finish rolling without cutting any crop portions of the steel sheets. Furthermore, in a case where a crop portion of a fishtail shape is cut, there is a deviation between a desired cutting location and a location at which a blade of the crop cutting machine actually comes in contact with the steel sheet, and hence the crop portion of the fishtail shape cannot always be cut at the desired cutting location. Therefore, in a case where a crop portion of a fishtail shape of a steel sheet having a larger sheet thickness, a larger sheet width and a lower temperature, for example, a hot-rolled steel sheet for a line pipe material is cut, a situation occurs in which the crop portion cannot be cut due to capacity shortage of the crop cutting machine.

Furthermore, according to a crop cutting method described in Patent Literature 2, rolling yield and sheet passing properties are taken into consideration, but there is not taken into consideration the deviation between the desired cutting location at which the crop portion is cut with the crop cutting machine and the location at which the blade of the crop cutting machine actually comes in contact with the steel sheet, and hence there is the case that a predetermined yield decrease effect or a sheet passing stabilizing effect cannot be obtained. Furthermore, in the steel sheet having the larger sheet thickness, larger sheet width and lower temperature, for example, the hot-rolled steel sheet for the line pipe material, the situation occurs in which the crop portion cannot be cut due to the capacity shortage of the crop cutting machine in accordance with the cutting location of the crop portion of the fishtail shape.

The present invention has been developed in view of such problems as mentioned above, and an object thereof is to provide a method for manufacturing a hot-rolled steel sheet in which a steel sheet having a larger sheet thickness, a larger sheet width and a lower temperature can also stably be cut without performing noticeable equipment modification such as reinforcement of a crop cutting machine, a steel sheet cutting location setting device, a steel sheet cutting location setting method, and a steel sheet manufacturing method.

Solution to Problem

To achieve the above object, the present inventors have earnestly studied a method of adjusting, into a fishtail shape, a shape of each of crop portions formed at a front end and a rear end of a steel sheet in a conveying direction in a rough rolling step prior to finish rolling, and cutting an intermediate portion between a concave portion bottom and each convex portion top of the fishtail shape, to decrease a cutting width (a total length of portions in which a blade of a crop cutting machine comes in contact with the steel sheet when cutting), thereby decreasing a cutting load.

In the rough rolling step prior to the finish rolling, the shape of each of the crop portions of the front end of the steel sheet in the conveying direction and the rear end thereof in the conveying direction can be adjusted into such a fishtail shape as illustrated in FIG. 1A. As illustrated in FIG. 2A, a conventional crop cutting location is a location at which the steel sheet is cut along its total width, but as illustrated in FIG. 2B, when the intermediate portion between the concave portion bottom and each convex portion top of the fishtail shape is cut, the cutting width decreases and hence the cutting load decreases as compared with the case where the steel sheet is cut along its total width.

Furthermore, a deviation is generated between a desired cutting location and a location at which the blade of the crop cutting machine actually comes in contact with the steel sheet, and hence depending on cutting location accuracy of the crop cutting machine, there is the case that the cutting load is in excess of a cutting load upper limit value of the crop cutting machine or the blade is swung uselessly without coming in contact with the fishtail shape of the crop portion, even though the desired cutting location of the crop portion of the fishtail shape is targeted to swing the blade of the crop cutting machine downward. To eliminate this problem, a fishtail length is sufficiently increased to prevent the cutting load from being in excess of the cutting load upper limit value of the crop cutting machine or prevent the blade from being swung uselessly, even in the case that the deviation is generated between the desired cutting location and the actual cutting location.

Furthermore, the deviation is generated between the desired cutting location and the location at which the blade of the crop cutting machine actually comes in contact with the steel sheet, and hence setting of the desired cutting location has to be performed in view of the deviation. It is necessary to set the desired cutting location so that, even in the case that the cutting location of the crop cutting machine shifts from the desired cutting location, the blade of the crop cutting machine can be swung down to the desired cutting location without coming in contact with a non-cuttable location or swinging uselessly.

The present invention has been developed on the basis of the above-mentioned findings and is constituted of the following gist.

(1) A method for manufacturing a hot-rolled steel sheet which comprises a rough rolling step and a finish rolling step and in which after the rough rolling step and before the finish rolling step, a crop portion of one of a front end of a steel sheet in a conveying direction and a rear end thereof in the conveying direction is cut or the crop portions of both of the ends are cut, and then the hot-rolled steel sheet is manufactured in the finish rolling step, wherein in the rough rolling step, a shape of each of the crop portions formed at the front end of the steel sheet in the conveying direction and the rear end thereof in the conveying direction is adjusted into a fishtail shape by use of one or both of a sizing press and a width rolling machine, the steel sheet is formed so that a length from a concave portion bottom to a convex portion top of the fishtail shape is from 200 to 300 mm, and an intermediate portion between the concave portion bottom and the convex portion top, defined as a desired cutting location is cut.

(2) The method for manufacturing the hot-rolled steel sheet according to the above (1), wherein the desired cutting location is set to a portion between a location of 110 mm from the concave portion bottom toward the convex portion top of the fishtail shape and a location of 90 mm from the convex portion top toward the concave portion bottom.

[1] A method for manufacturing a hot-rolled steel sheet which comprises a rough rolling step and a finish rolling step and in which after the rough rolling step and before the finish rolling step, a crop portion of a front end of a steel sheet in a conveying direction is cut, and then the steel sheet is finish-rolled in the finish rolling step to manufacture the hot-rolled steel sheet, wherein in the rough rolling step, a shape of the crop portion formed at the front end of the steel sheet in the conveying direction is adjusted into a fishtail shape by width rolling of a width rolling machine and horizontal rolling of a horizontal rough rolling machine, the steel sheet is formed so that the shortest length L (mm) from a concave portion bottom to a convex portion top of the fishtail shape satisfies Equation (1) mentioned below, and an intermediate portion between the concave portion bottom and the convex portion top, defined as a desired cutting location, is cut:

$$(2X+30) \leq L \leq 300 \quad (1),$$

in which X is a maximum deviation (mm) of the cutting location of a crop cutting machine and $0 \leq X \leq 90$.

[2] The method for manufacturing the hot-rolled steel sheet according to the above [1], wherein in the rough rolling step, in addition to the crop portion formed at the front end of the steel sheet in the conveying direction, a shape of a crop portion formed at a rear end of the steel sheet in the conveying direction is adjusted into a fishtail shape that satisfies Equation (1) mentioned above, and an intermediate portion between a concave portion bottom and a convex portion top of the fishtail shape, defined as a desired cutting location is cut.

[3] The method for manufacturing the hot-rolled steel sheet according to the above [1] or [2], wherein the desired cutting location is set to a portion between a location of (X+20) mm from the concave portion bottom toward the convex portion top of the fishtail shape and a location of (X+5) mm from the convex portion top toward the concave portion bottom.

[4] The method for manufacturing the hot-rolled steel sheet according to any one of the above [1] to [3], wherein in the rough rolling step, a width rolling amount $W_R$ (mm) by the width rolling machine is from 30 to 50 mm.

[5] The method for manufacturing the hot-rolled steel sheet according to any one of the above [1] to [3], wherein in the rough rolling step, the steel sheet is subjected to width reduction by a sizing press prior to the width rolling by the width rolling machine.

[6] The method for manufacturing the hot-rolled steel sheet according to the above [5], wherein in the rough rolling step, a width pressing amount $W_P$ (mm) of the sizing press is from 150 to 250 mm and a width rolling amount $W_R$ (mm) by the width rolling machine is 10 mm or more and smaller than 40 mm.

[7] The method for manufacturing the hot-rolled steel sheet according to the above [5], wherein in the rough rolling step, a width pressing amount $W_P$ (mm) of the sizing press is smaller than 150 mm or in excess of 250 mm and 400 mm or less and a width rolling amount $W_R$ (mm) by the width rolling machine is from 30 to 50 mm.

Furthermore, according to one aspect of the present invention, there is provided a steel sheet cutting location setting device in which a cutting location of a crop portion is set with an arithmetic processing unit having an arithmetic processing function in a case where the crop portion formed into a fishtail shape at a front end of a steel sheet in a conveying direction or a rear end thereof in the conveying direction by rough rolling is cut with a crop cutting machine prior to finish rolling, the steel sheet cutting location setting device comprising a crop portion shape reading unit configured to read the shape of the crop portion which is detected by a crop shape meter; a crop portion temperature distribution reading unit configured to read a temperature distribution of the crop portion which is detected by a crop thermometer; a first cutting location calculating unit configured to calculate, as a first cutting location, a location of a preset length from a concave portion bottom toward a convex portion top of the fishtail shape in the steel sheet conveying direction, in the read shape of the crop portion; a cutting load distribution calculating unit configured to calculate, from the read temperature distribution of the crop portion, a cutting load distribution in the crop portion to the steel sheet conveying direction; a second cutting location calculating unit configured to calculate, as a second cutting location, a location at which a cutting load of the crop portion is not more than a cutting load upper limit value of the crop cutting machine, in the calculated cutting load distribution in the crop portion to the steel sheet conveying direction; and a concave portion side cutting location setting unit configured to set, as a concave portion side cutting location at which the crop portion is cuttable, one of the calculated first cutting location and the calculated second cutting location which has a larger distance from the concave portion bottom of the fishtail shape.

Furthermore, according to another aspect of the present invention, there is provided a steel sheet cutting location setting method in which a cutting location of a crop portion is set with an arithmetic processing unit having an arithmetic processing function in a case where the crop portion formed into a fishtail shape at a front end of a steel sheet in a conveying direction or a rear end thereof in the conveying direction by rough rolling is cut with a crop cutting machine prior to finish rolling, the steel sheet cutting location setting method comprising a crop portion shape reading step of reading the shape of the crop portion which is detected by a crop shape meter; a crop portion temperature distribution reading step of reading a temperature distribution of the crop portion which is detected by a crop thermometer; a first cutting location calculating step of calculating, as a first cutting location, a location of a preset length from a concave portion bottom toward a convex portion top of the fishtail shape in the steel sheet conveying direction, in the read shape of the crop portion; a cutting load distribution calculating step of calculating, from the read temperature distribution of the crop portion, a cutting load distribution in the crop portion to the steel sheet conveying direction; a second cutting location calculating step of calculating, as a second cutting location, a location at which a cutting load of the crop portion is not more than a cutting load upper limit value of the crop cutting machine, in the calculated cutting load distribution in the crop portion to the steel sheet conveying direction; a concave portion side cutting location setting step of setting, as a concave portion side cutting location at which the crop portion is cuttable, one of the calculated first cutting location and the calculated second cutting location which has a larger distance from the concave portion bottom of the fishtail shape; a convex portion side cutting location setting step of setting, as a convex portion side cutting location at which the crop portion is cuttable, a location of a preset length from the convex portion top toward the concave portion bottom of the fishtail shape in the steel sheet conveying direction, in the read shape of the crop portion; and a crop portion cutting location setting step of setting, as a cutting location of the crop portion, a portion between the concave portion side cutting location and the convex portion side cutting location.

Furthermore, according to still another aspect of the present invention, there is provided a steel sheet manufacturing method in which width reduction is performed by using a sizing press or a width rolling machine to adjust, into a fishtail shape, a shape of a crop portion of a front end of a steel sheet in a conveying direction or a rear end thereof in the conveying direction.

Advantageous Effects of Invention

According to the present invention, when a crop portion of a steel sheet before finish-rolled is cut, an intermediate portion between a concave portion bottom and a convex portion top of a fishtail shape is cut, and hence the steel sheet having a larger sheet thickness, a larger sheet width and a lower temperature can be cut at a cutting load equal to that of a conventional steel sheet having a usual sheet thickness, a usual sheet width and a usual temperature. In particular, a steel sheet having a large sheet thickness of 50 to 100 mm, a large sheet width of 1200 to 2100 mm and a low temperature of 800 to 1050° C. can be cut without performing noticeable equipment modification such as reinforcement of a crop cutting machine. Furthermore, a most front end of the steel sheet in a conveying direction and a most rear end thereof in the conveying direction can be arranged vertically to an approaching direction to a finish rolling machine, and further, a temperature drop portion due to cooling of four surfaces can be removed, and hence stability of sheet passing through the finish rolling machine can be acquired.

Furthermore, a fishtail length is increased so that a blade of the crop cutting machine does not come in contact with a location at which the steel sheet is not cuttable, and hence also in the case that a deviation is generated between a desired cutting location and a location at which the blade of the crop cutting machine actually comes in contact with the steel sheet, the intermediate portion between the concave portion bottom and the convex portion top of the fishtail shape can always be cut without being in excess of a cutting load upper limit value of the crop cutting machine.

Furthermore, the desired cutting location is determined so that the blade of the crop cutting machine does not come in contact with the location at which the steel sheet is not cuttable and so that the blade is prevented from swinging uselessly when cutting, and therefore, it is always possible to stably cut the intermediate portion between the concave portion bottom and the convex portion top of the fishtail shape without being in excess of the cutting load upper limit value of the crop cutting machine and without swinging uselessly.

According to the present invention, it can beforehand be prevented that the steel sheet having the larger sheet thickness, the larger sheet width and the lower temperature cannot be cut due to capacity shortage of the crop cutting machine. Furthermore, the steel sheet can stably be cut without performing noticeable equipment modification such as the reinforcement of the crop cutting machine.

DESCRIPTION OF EMBODIMENTS

Embodiments mentioned below illustrate a device and a method which embody technical ideas of the present invention, and the technical ideas of the present invention do not specify a material, a shape, a structure, an arrangement and the like of constituent components to those mentioned below. Various changes can be added to the technical ideas of the present invention in a technical scope stipulated by claims described in a scope of patent claim.

One embodiment of the present invention will now be described.

A process for manufacturing a hot-rolled steel sheet is a process of manufacturing steel strips from a slab, and the process is roughly divided into a heating step, a rough rolling step, a finish rolling step, a cooling step and a winding step in a step order. Hereinafter, a heating step side will be defined as an upstream side and a winding step side will be defined as a downstream side to make description.

In the heating step, the slab is heated at 1100 to 1300° C. in a heating furnace and extracted onto a table to be conveyed to the subsequent steps.

In the rough rolling step, the conveyed slab is subjected to width rolling and horizontal rolling by a width rolling machine and a rough rolling machine each of which comprises at least a pair of rollers. The width rolling machines are disposed on the upstream side and the downstream side of the rough rolling machine or the width rolling machine is disposed on one of the upstream side and the downstream side. The width rolling and the horizontal rolling are performed in a forward direction toward a downstream step side or in a backward direction toward an upstream step side. Furthermore, in the rough rolling step, the width rolling and the horizontal rolling are performed only in the forward direction, or are repeated in the forward direction and the backward direction at least twice or more. In the rough rolling step, the slab is formed into a sheet bar having a predetermined sheet width and a predetermined sheet thickness by the above-mentioned operation.

Furthermore, in the rough rolling step, there is a case where a sizing press to reduce the slab in a width direction is disposed on the upstream side from the rough rolling machine. This sizing press has a slab width reducing efficiency better than that of the width rolling machine and is therefore used to noticeably decrease a width of the slab.

In the finish rolling step, the sheet bar is horizontally rolled by using a finish rolling machine comprising at least one horizontal rolling machine comprising a pair of upper and lower rollers. At this time, the horizontal rolling is performed in one direction.

The cooling step is a step of spraying, from the upside and the downside, water to the finish-rolled steel sheet that is being conveyed to cool the steel sheet.

The winding step is a step of winding the cooled steel sheet in the form of a column by a coiler.

Figure 1A:
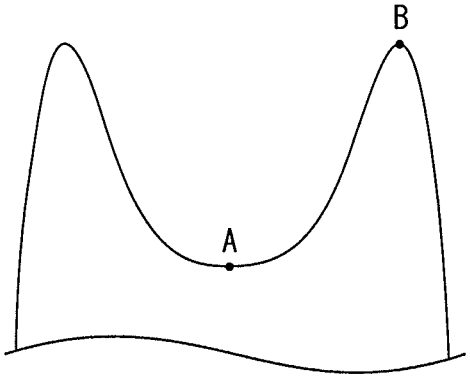
FIGS. 1A to 1D are schematic views illustrative of a planar shape of each of crop portions formed at a front end of a steel sheet in a conveying direction and a rear end thereof in the conveying direction.
Figure 1B:
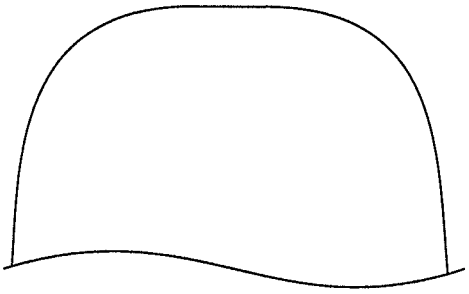
Figure 1C:
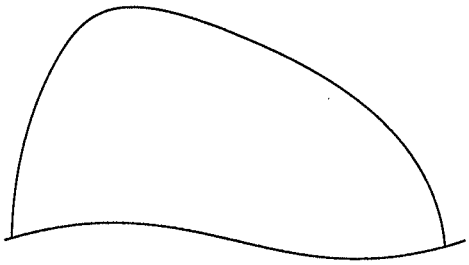
Figure 1D:
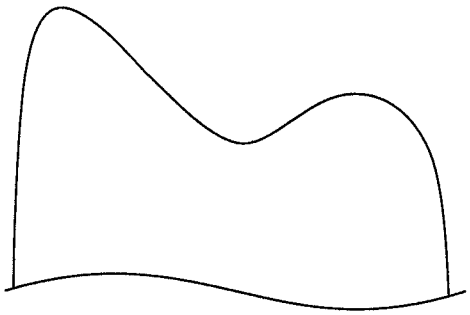

The sheet bar is the steel sheet subjected to the rough rolling step before the finish rolling. A front end and a rear end of the sheet bar in the conveying direction are deformed into various shapes by the horizontal rolling and the width rolling in the rough rolling step and width reduction of the sizing press, to form crop portions. For example, FIG. 1B illustrates the crop portion of a tongue shape in which a sheet width central portion extends longer than each sheet width end portion in a rolling direction. Furthermore, FIG. 1A illustrates the crop portion of a fishtail shape in which each sheet width end portion extends longer than a sheet width central portion in the rolling direction. Furthermore, there are also cases where shapes are laterally asymmetric, FIG. 1C illustrates a laterally asymmetric tongue shape, and FIG. 1D illustrates a laterally asymmetric fishtail shape.

A shape of each of the crop portions of the front end and the rear end of the sheet bar in the conveying direction can be adjusted into a desirable shape by adjusting, in the rough rolling step, a width rolling amount of the width rolling machine, a rolling amount of a horizontal rough rolling machine, the number of paths in the rough rolling step, and a width pressing amount by the sizing press. In the present invention, the shape of each of the crop portions of the front end and the rear end of the sheet bar in the conveying direction is adjusted into such a fishtail shape as illustrated in FIG. 1A to decrease a cutting width of the crop portion.

The width rolling by the width rolling machine and the width reduction by the sizing press are defined as processing of deforming the sheet width end portions prior to the horizontal rolling by rough rolling. Therefore, to form the front end and the rear end of the sheet bar in the conveying direction into the fishtail shape, it is necessary to dispose, in the rough rolling step, at least one width rolling machine or at least one sizing press, or at least one width rolling machine and at least one sizing press.

A cutting system of a crop cutting machine is usually roughly divided into three types of a guillotine type, a crank type and a drum type, but any cutting type may be used as long as the crop portions of the front end and the rear end of the sheet bar in the conveying direction can be cut in the width direction.

A cutting load to be applied to the crop cutting machine is influenced by a sheet thickness of a portion in which a blade of the crop cutting machine comes in contact with the sheet bar during cutting. This sheet thickness is called a cutting thickness. In general, the sheet thickness of the sheet bar is constant in the rolling direction, and hence it may be considered that the cutting thickness is equal to a sheet thickness of a steady portion of the sheet bar. In an actual operation, it is difficult to strictly measure the sheet thickness of the portion in which the blade of the crop cutting machine comes in contact with the sheet bar or the sheet thickness of the steady portion, and hence the sheet thickness of the sheet bar which is measured by a measuring instrument or the sheet thickness of the sheet bar which is set in accordance with a schedule of the rough rolling may be defined as the cutting thickness. In the sheet bar in which the cutting thickness is 50 mm or more, an intermediate portion between a concave portion bottom and a convex portion top of the fishtail shape of the crop portion formed in the sheet bar is cut to decrease the cutting load. Here, the intermediate portion is a portion of a location that is present in a region between the concave portion bottom and the convex portion top of the fishtail shape.

Furthermore, the cutting load to be applied to the crop cutting machine is also influenced by a total length of the portion in which the blade of the crop cutting machine comes in contact with the sheet bar during the cutting. This total length is called the cutting width. In general, the sheet width of the sheet bar is constant in the rolling direction except for unsteady portions of the front end and the rear end of the sheet bar in the conveying direction, and hence a maximum cutting width is equal to the sheet width of the steady portion of the sheet bar. However, in a method of the present invention, the unsteady portion is cut along its width, and hence the cutting width is noticeably smaller than the sheet width of the steady portion. In the actual operation, it is difficult to strictly measure the total length of the portion in which the blade of the crop cutting machine comes in contact with the sheet bar, or the sheet width of the steady portion, and hence a sheet bar width measured with the measuring instrument or a sheet bar width set in accordance with the schedule of the rough rolling may be defined as the maximum cutting width. In the sheet bar in which this maximum cutting width is 1200 mm or more, the intermediate portion between the concave portion bottom and the convex portion top of the fishtail shape of the crop portion formed in the sheet bar is cut to decrease the cutting load.

Furthermore, the cutting load to be applied to the crop cutting machine is influenced by a sheet bar temperature of the contact portion in which the blade of the crop cutting machine comes in contact with the sheet bar during the cutting. This temperature is called a cutting temperature. In the actual operation, it is difficult to measure the sheet bar temperature of the contact portion in which the blade of the crop cutting machine comes in contact with the sheet bar, and hence a surface temperature of the sheet bar which is measured with the measuring instrument or a setting temperature of the sheet bar which is set in accordance with the schedule of the rough rolling may be defined as the cutting temperature. In a case where this cutting temperature is 1050° C. or less, the intermediate portion between the concave portion bottom and the convex portion top of the fishtail shape of the crop portion formed in the sheet bar is cut to decrease the cutting load.

Furthermore, in a case where the sheet bar is cut with the crop cutting machine, a deviation is generated between a desired cutting location and a location at which the blade of the cutting machine actually comes in contact with the sheet bar, and the deviation depends on tracking accuracy of the steel sheet and is ±90 mm at maximum. To eliminate this problem, for the purpose of securely cutting the intermediate portion between the concave portion bottom and the convex portion top of the fishtail shape of the crop portion formed in the sheet bar, a length from the concave portion bottom to the convex portion top of the fishtail shape is set to 200 mm or more, and from the viewpoint of product yield, an upper limit of the length is set to 300 mm.

For the purpose of setting, to 200 mm or more, the length from the concave portion bottom to the convex portion top of the fishtail shape of each of the crop portions formed at the front end and the rear end of the sheet bar in the conveying direction, a width reduction pressing amount of the sizing press and the width rolling amount of the width rolling machine have to be changed from conventional conditions. In a conventional operation, a location at which the crop portions of the front end and the rear end of the sheet bar in the conveying direction are cut is defined as a steady deformed portion of the sheet bar, and the sheet bar is cut along its total width. Therefore, a crop length is decreased to decrease a cutting amount, thereby improving the yield. That is, the width reduction pressing amount of the sizing press and the width rolling amount of the width rolling machine is set to decrease the length from the concave portion bottom to the convex portion top of the fishtail shape of each of the crop portions formed at the front end and the rear end of the sheet bar in the conveying direction. On the other hand, for the purpose of cutting the intermediate portion between the concave portion bottom and the convex portion top of the fishtail shape of each of the crop portions formed at the front end and the rear end of the sheet bar in the conveying direction, it is necessary to increase the length from the concave portion bottom to the convex portion top of the fishtail shape, and it is necessary to change the conventional conditions of the sizing press and the width rolling.

To increase the length from the concave portion bottom to the convex portion top of the fishtail shape of each of the crop portions formed at the front end and the rear end of the sheet bar in the conveying direction by use of the sizing press, it is preferable that the width reduction pressing amount is about 200 mm. When the width reduction pressing amount is 200 mm or less, width end portions of the slab are only deformed by the width reduction to increase the thickness of each width end portion, and hence together with increase of the width reduction pressing amount, there increases the length from the concave portion bottom to the convex portion top of the fishtail shape of each of the crop portions formed at the front end and the rear end of the sheet bar horizontally rolled by the subsequent rough rolling in the conveying direction. On the other hand, when the width reduction pressing amount is 200 mm or more, a slab width central portion is also deformed by the width reduction, and hence a thickness of a slab width central portion increases. This thickened slab width central portion is stretched in the rolling direction by the horizontal rolling of the rough rolling machine after the width reduction is performed with the sizing press, and hence there decreases the length from the concave portion bottom to the convex portion top of the fishtail shape of each of the crop portions formed at the front end and the rear end of the sheet bar in the conveying direction. In summary, it can be seen that the length from the concave portion bottom to the convex portion top of the fishtail shape of each of the crop portions formed at the front end and the rear end of the sheet bar in the conveying direction becomes a maximum length, when the width reduction pressing amount is 200 mm.

To increase the length from the concave portion bottom to the convex portion top of the fishtail shape of each of the crop portions formed at the front end and the rear end of the sheet bar in the conveying direction by use of the width rolling machine, it is preferable that the width rolling amount of each path is increased as much as possible. In the width rolling, width end portions of a material to be rolled (the slab) are only deformed, and hence, by increasing the width rolling amount, a thickness of each width end portion of the slab is only increased before performing the horizontal rolling with the rough rolling machine. As a result, there increases the length from the concave portion bottom to the convex portion top of the fishtail shape of each of the crop portions formed at the front end and the rear end of the sheet bar in the conveying direction. A conventional material is subjected to width rolling so that a difference between a sheet width obtained by the sizing press and a sheet width of the roughly rolled sheet bar is 20 mm or less. However, for the purpose of securely cutting the intermediate portion between the concave portion bottom and the convex portion top of the fishtail shape of each of the crop portions formed at the front end and the rear end of the sheet bar in the conveying direction, it is necessary to increase the length from the concave portion bottom to the convex portion top of the fishtail shape, and hence the width rolling has to be performed by setting, to 20 mm or more, the difference between the sheet width obtained by the sizing press and the sheet width of the roughly rolled sheet bar.

As described above, examples of a method of increasing the length from the concave portion bottom to the convex portion top of the fishtail shape of each of the crop portions formed at the front end and the rear end of the sheet bar in the conveying direction include a method using the sizing press and a method using the width rolling machine, and by using one or both of these two methods, the sheet bar is formed so that the length from the concave portion bottom to the convex portion top of the fishtail shape is 200 mm or more.

Figure 2A:
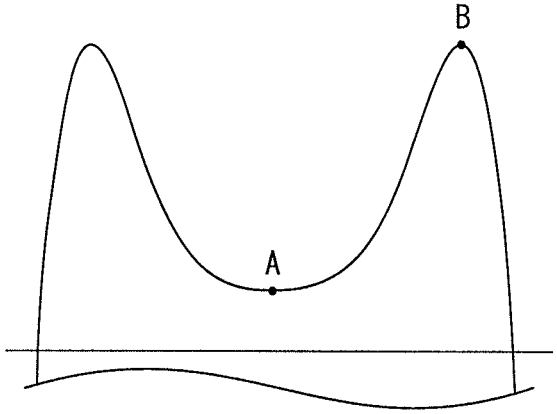
FIGS. 2A and 2B are schematic views illustrative of a cutting location of the crop portion.
Figure 2B:
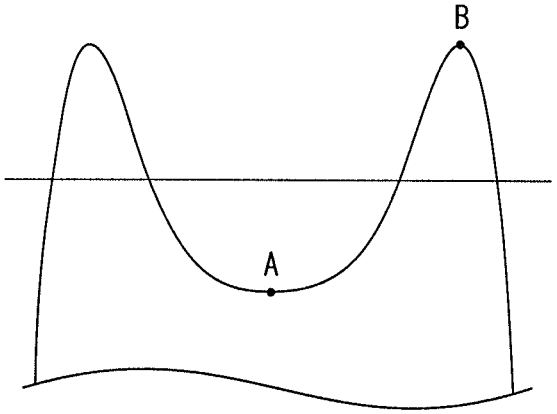
Figure 3:
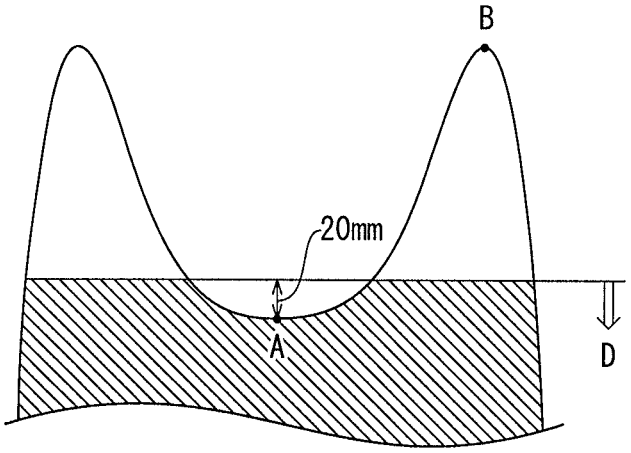
FIG. 3 is a schematic view illustrative of a region of a non-cuttable location.

In a case where the crop portions of the fishtail shapes formed at the front end and the rear end of the sheet bar in the conveying direction, depending on the sheet width, the sheet thickness and the cutting temperature of the sheet bar, a load in excess of the cutting load upper limit value of the crop cutting machine would be generated, even though the intermediate portion between the concave portion bottom and the convex portion top of the fishtail shape is cut. As seen from FIGS. 2A and 2B, in the case where the crop portion of the fishtail shape is cut, the cutting width changes with a cutting location. That is, also in the case where the intermediate portion between the concave portion bottom and the convex portion top of the fishtail shape is cut, the cutting width varies with the cutting location, and hence the cutting load changes. When the cutting width is large, the cutting load is large, and when the cutting width is small, the cutting load is small. Therefore, the cutting load increases closer to the concave portion bottom of the fishtail shape. That is, depending on the cutting location, there is the case that the cutting location is present at which the cutting load is in excess of the cutting load upper limit value of the crop cutting machine, even though the intermediate portion between the concave portion bottom and the convex portion top of the fishtail shape is cut. The cutting location at which the cutting load is in excess of the cutting load upper limit value of the crop cutting machine is defined as a non-cuttable location. As illustrated in FIG. 3, the non-cuttable location is also present in an intermediate portion between a convex portion top and a concave portion bottom that is just beyond the concave portion bottom of the fishtail shape from a steady deformed portion of the sheet bar toward the convex portion top of the fishtail shape of the crop portion, and the non-cuttable location is a location in a region of 20 mm or less from the concave portion bottom toward the convex portion top of the fishtail shape.

Figure 4A:
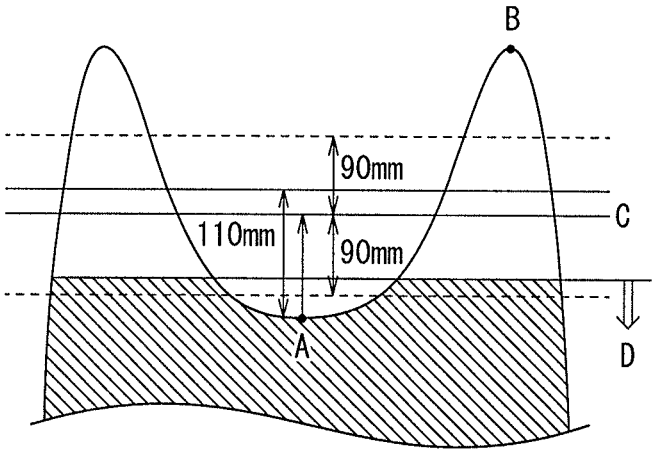
FIGS. 4A and 4B are schematic views illustrative of a deviation between a desired cutting location and a location at which a blade of a cutting machine actually comes in contact with the steel sheet.

In a case where the sheet bar is cut with the crop cutting machine, a deviation is generated between the desired cutting location of the sheet bar and the location at which the blade of the crop cutting machine actually comes in contact with the sheet bar. The deviation depends on accuracy of tracking of the sheet bar and is ±90 mm at maximum. In a case where the desired cutting location is set to a proximal location shorter than 110 mm from the concave portion bottom toward the convex portion top of the fishtail shape, as illustrated in FIG. 4A, there is the possibility that the blade of the crop cutting machine comes in contact with the non-cuttable location of the fishtail shape, when the location at which the blade of the crop cutting machine actually comes in contact with the sheet bar shifts as much as 90 mm from the desired cutting location toward the concave portion bottom. Consequently, it is preferable that the desired cutting location is set to a location on a convex portion top side of the location of 110 mm from the concave portion bottom toward the convex portion top of the fishtail shape.

Figure 4B:
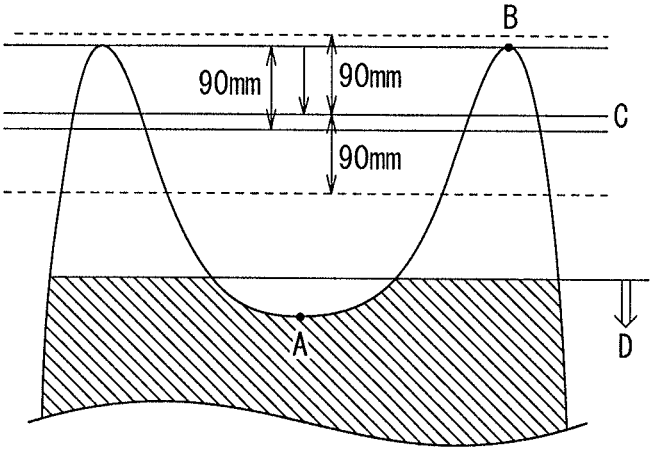

Furthermore, in a case where a distance between the desired cutting location and the convex portion top of the fishtail shape is 90 mm or less as illustrated in FIG. 4B, when the location at which the blade of the crop cutting machine actually comes in contact with the sheet bar shifts as much as 90 mm from the desired cutting location toward the convex portion top, there is the possibility that the blade swings uselessly. Consequently, it is preferable that the desired cutting location is set to a location on the concave portion bottom side of a location of 90 mm from the convex portion top toward the concave portion bottom of the fishtail shape.

Figure 5:
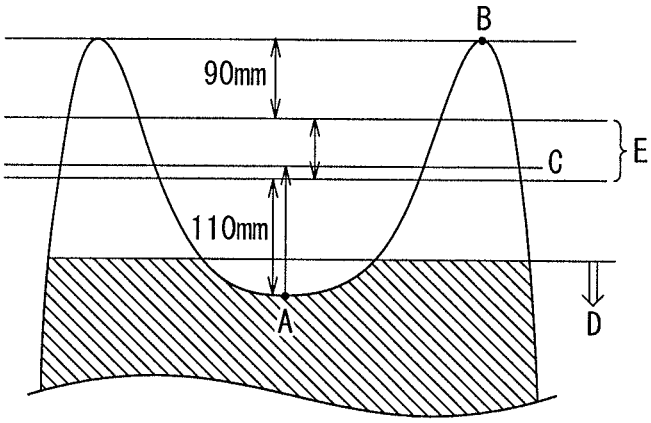
FIG. 5 is a schematic view illustrative of a setting range of the desired cutting location.

From the above, when the intermediate portion between the concave portion bottom and the convex portion top of the fishtail shape of the crop portion formed in the sheet bar is cut, for the purpose of cutting the intermediate portion without being in excess of the cutting load upper limit value of the crop cutting machine and without swinging the blade uselessly, it is preferable to set the desired cutting location to a portion between the location of 110 mm from the concave portion bottom toward the convex portion top of the fishtail shape and the location of 90 mm from the convex portion top toward the concave portion bottom. FIG. 5 illustrates a preferable range of the intermediate portion between the concave portion bottom and the convex portion top of the fishtail shape, to which the desired cutting location is set. When the desired cutting location is set as described above, the cutting can be performed without being in excess of the cutting load upper limit value of the crop cutting machine and without swinging the blade uselessly, also in a case where the deviation between the desired cutting location and the location at which the blade of the crop cutting machine actually comes in contact with the sheet bar is ±90 mm.

The shape of the fishtail of each of the crop portions formed at the front end and the rear end of the sheet bar in the conveying direction and subjected to the rough rolling step is measured with a shape meter disposed before the crop cutting machine. The length from the concave portion bottom to the convex portion top of the fishtail shape is confirmed with the shape meter.

Furthermore, in place of the above shape meter, the shape may visually be confirmed by an operator or another means may be used as long as the shape of the fishtail can be judged.

For sheet bars to manufacture hot-rolled steel sheets for line pipe materials (a sheet thickness: 60 mm, a sheet width: 1500 mm, and a finish rolling machine inlet side temperature: 900° C.), manufacturing conditions of a rough rolling step were changed to prepare the sheet bars having crop portions of various fishtail shapes, and there was measured a cutting load when each of the crop portions of the fishtail shapes at front ends and rear ends of the sheet bars in a conveying direction was cut with a crop cutting machine. A fatigue limit load of the crop cutting machine was 6.47 MN, and hence it was judged that the cutting was impossible in a case where the cutting load of 6.47 MN or more was applied. Table 1 illustrates cutting loads in cases (Nos. 1 to 4) where a steady deformed portion of each sheet bar was cut, to confirm a difference in cutting load between a case where the steady deformed portion was cut in which a cutting width was a total width of the sheet bar and a case where a fishtail portion was cut. All the cutting loads were in excess of 6.47 MN and in excess of the fatigue limit load of the crop cutting machine. Table 2 illustrates cutting loads in cases (Nos. 5 to 20) where the crop portion of the fishtail shape was targeted and cut. Nos. 5 to 8 illustrate examples in each of which conditions of sizing press and width rolling in a rough rolling step were set so that a length from a concave portion bottom to a convex portion top of the fishtail shape of the crop portion at the front end of the sheet bar in the conveying direction was 100 mm, Nos. 9 to 12 illustrate examples in each of which the conditions were set so that the length was 150 mm, Nos. 13 to 16 illustrate examples in each of which the conditions were set so that the length was 200 mm, and Nos. 17 to 30 illustrate examples in each of which the conditions were set so that the length was 250 mm. As seen from Table 2, the cutting load would be in excess of 6.47 MN in a case where the length from the concave portion bottom to the convex portion top of the fishtail shape is smaller than 200 mm. On the other hand, it is seen that, in the examples of the present invention in which the length from the concave portion bottom to the convex portion top of the fishtail shape is larger than 200 mm, all the cutting loads are smaller than 6.47 MN and the cutting with the crop cutting machine is possible. Furthermore, it has been confirmed that in all the sheet bars in each of which the intermediate portion between the concave portion bottom and the convex portion top of the fishtail shape is cut, troubles of sheet passing during finish rolling, e.g., meandering, biting defects, squeezing and bends are not generated and it is possible to stabilize the sheet passing through a finish rolling machine by a crop cutting method of the present invention.

TABLE 1

| Sheet bar | | Cutting load |
|---|---|---|
| No. | Cut portion | [MN] |
| 1 | Front end | 7.83 |
| | Rear end | 7.85 |
| 2 | Front end | 7.83 |
| | Rear end | 7.78 |
| 3 | Front end | 7.92 |
| | Rear end | 7.77 |
| 4 | Front end | 7.88 |
| | Rear end | 7.83 |

TABLE 2

| Sheet bar | | Fish-tail | Desired cutting | Actual cutting | Cutt-ing | | |
|---|---|---|---|---|---|---|---|
| No. | Cut portion | length [mm] | location [mm] | location [mm] | load [MN] | Cutta-bility | Remarks |
| 5 | Front end | 98 | 50 | 15 | 7.11 | x | Comparative example |
| | Rear end | 131 | 50 | 55 | 4.92 | ○ | Comparative example |
| 6 | Front end | 101 | 50 | Useless swinging | | x | Comparative example |
| | Rear end | 129 | 50 | Useless swinging | | x | Comparative example |

TABLE 2-continued

| Sheet bar No. | Cut portion | Fish-tail length [mm] | Desired cutting location [mm] | Actual cutting location [mm] | Cutting load [MN] | Cuttability | Remarks |
|---|---|---|---|---|---|---|---|
| 7 | Front end | 105 | 50 | 35 | 5.59 | ○ | Comparative example |
| | Rear end | 135 | 50 | 19 | 7.24 | x | Comparative example |
| 8 | Front end | 104 | 50 | 55 | 3 97 | ○ | Comparative example |
| | Rear end | 132 | 50 | 40 | 5.89 | ○ | Comparative example |
| 9 | Front end | 147 | 75 | 16 | 7.51 | x | Comparative example |
| | Rear end | 175 | 75 | 12 | 7.89 | x | Comparative example |
| 10 | Front end | 148 | 75 | 75 | 4.13 | ○ | Comparative example |
| | Rear end | 180 | 75 | Useless swinging | | x | Comparative example |
| 11 | Front end | 151 | 75 | 80 | 4.00 | ○ | Comparative example |
| | Rear end | 181 | 75 | −5 | 7.92 | x | Comparative example |
| 12 | Front end | 152 | 75 | Useless swinging | | x | Comparative example |
| | Rear end | 179 | 75 | 150 | 1.34 | x | Comparative example |
| 13 | Front end | 205 | 110 | 50 | 6.56 | ○ | Present invention example |
| | Rear end | 235 | 110 | 150 | 3.05 | ○ | Present invention example |
| 14 | Front end | 203 | 110 | 140 | 2.57 | ○ | Present invention example |
| | Rear end | 234 | 110 | 60 | 6.29 | ○ | Present invention example |
| 15 | Front end | 201 | 110 | 84 | 4.90 | ○ | Present invention example |
| | Rear end | 230 | 110 | 142 | 3.25 | ○ | Present invention example |
| 16 | Front end | 200 | 110 | 186 | 0.61 | ○ | Present invention example |
| | Rear end | 228 | 110 | 124 | 3.88 | ○ | Present invention example |
| 17 | Front end | 251 | 110 | 134 | 3.88 | ○ | Present invention example |
| | Rear end | 275 | 130 | 121 | 4.57 | ○ | Present invention example |
| 18 | Front end | 250 | 130 | 78 | 5.83 | ○ | Present invention example |
| | Rear end | 286 | 130 | 164 | 3.59 | ○ | Present invention example |
| 19 | Front end | 247 | 130 | 184 | 2.17 | ○ | Present invention example |
| | Rear end | 280 | 130 | 157 | 3.75 | ○ | Present invention example |
| 20 | Front end | 255 | 130 | 133 | 4.05 | ○ | Present invention example |
| | Rear end | 279 | 130 | 101 | 5.42 | ○ | Present invention example |

A different embodiment of the present invention will now be described.

In a case where a sheet bar is cut with a crop cutting machine, a deviation is generated between a desired cutting location and a location at which a blade of the crop cutting machine actually comes in contact with the sheet bar, and a maximum deviation X (mm) depends on accuracy of tracking of a steel sheet and is usually from 0 to 90 mm. To eliminate such a problem, for the purpose of securely cutting an intermediate portion between a concave portion bottom and a convex portion top of a fishtail shape of a crop portion formed at a front end of the sheet bar in a conveying direction, the shortest length L (mm) from the concave portion bottom to the convex portion top of the fishtail shape is adjusted to be (2X+30) mm or more, and an upper limit of the shortest length L is set to 300 mm from the viewpoint of product yield. That is, the sheet bar is formed so that the shortest length L (mm) from the concave portion bottom to the convex portion top of the fishtail shape satisfies Equation (1) mentioned below:

$$(2X+30) \leq L \leq 300 \quad (1),$$

in which X is a maximum deviation (mm) of the cutting location of the crop cutting machine and $0 \leq X \leq 90$.

When the shortest length L is smaller than (2X+30) mm and the intermediate portion between the concave portion bottom and the convex portion top of the fishtail shape is defined as the desired cutting location and cut, there occurs the case that the blade swings uselessly or that a load is in excess of a cutting load upper limit value of the crop cutting machine.

Furthermore, in a case where a crop portion of a rear end of the sheet bar in the conveying direction is cut in addition to the crop portion of the front end of the sheet bar in the conveying direction, it is preferable that a shape of the crop portion formed at the rear end of the sheet bar in the conveying direction is adjusted into a fishtail shape that satisfies Equation (1) mentioned above, and an intermediate portion between a concave portion bottom and a convex portion top of the fishtail shape is defined as the desired cutting location and cut.

The fishtail shape of each of the crop portions formed at the front end and the rear end of the sheet bar in the conveying direction can be adjusted into a desirable shape by controlling, in a rough rolling step, a width rolling amount of a width rolling machine, a rolling amount of a horizontal rough rolling machine, the number of paths in the rough rolling step, and a width pressing amount by a sizing press.

Furthermore, in a case where the crop portion of each of the fishtail shapes formed at the front end and the rear end of the sheet bar in the conveying direction is cut, depending on a sheet width, a sheet thickness and a cutting temperature of the sheet bar, there occurs the case that a load in excess of the cutting load upper limit value of the crop cutting machine is generated, even though the intermediate portion between the concave portion bottom and the convex portion top of the fishtail shape is cut. As seen from FIGS. 2A and 2B, in the case where the crop portion of the fishtail shape is cut, a cutting width changes with the cutting location. That is, even in the case where the intermediate portion between the concave portion bottom and the convex portion top of the fishtail shape is cut, the cutting width varies with the cutting location, and hence the cutting load changes. When the cutting width is large, the cutting load is large, and when the cutting width is small, the cutting load is small. Therefore, the cutting load increases closer to the concave portion bottom of the fishtail shape. That is, depending on the cutting location, there is the case that the cutting location is present at which the cutting load is in excess of the cutting load upper limit value of the crop cutting machine, even though the intermediate portion between the concave portion bottom and the convex portion top of the fishtail shape is cut. The cutting location at which the cutting load is in excess of the cutting load upper limit value of the crop cutting machine is defined as a non-cuttable location. As illustrated in FIG. 3, the non-cuttable location is also present in an intermediate portion between a convex portion top and a concave portion bottom that is just beyond the concave portion bottom of the fishtail shape from a steady deformed portion of the sheet bar toward the convex portion top of the fishtail shape of the crop portion, and the non-cuttable location is a location in a region of 20 mm or less from the concave portion bottom toward the convex portion top of the fishtail shape.

Figure 6A:
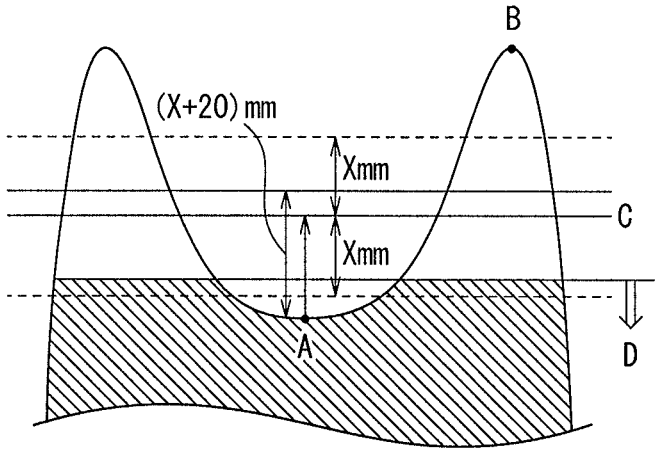
FIGS. 6A and 6B are schematic views illustrative of the deviation between the desired cutting location and the location at which the blade of the cutting machine actually comes in contact with the steel sheet.

As described above, in the case where the sheet bar is cut with the crop cutting machine, a deviation is generated between the desired cutting location of the sheet bar and the location at which the blade of the crop cutting machine actually comes in contact with the sheet bar, and its maximum deviation X depends on accuracy of tracking of the sheet bar and is usually from 0 to 90 mm. In a case where the desired cutting location is set to a proximal location shorter than (X+20) from the concave portion bottom toward the convex portion top of the fishtail shape, as illustrated in FIG. 6A, there is the possibility that the blade of the crop cutting machine comes in contact with the non-cuttable location of the crop portion of the fishtail shape, when the location at which the blade of the crop cutting machine actually comes in contact with the sheet bar shifts as much as X (mm) from the desired cutting location toward the concave portion bottom. Consequently, it is preferable that the desired cutting location is set to a location on a convex portion top side of the location of (X+20) mm from the concave portion bottom toward the convex portion top of the fishtail shape.

Figure 6B:
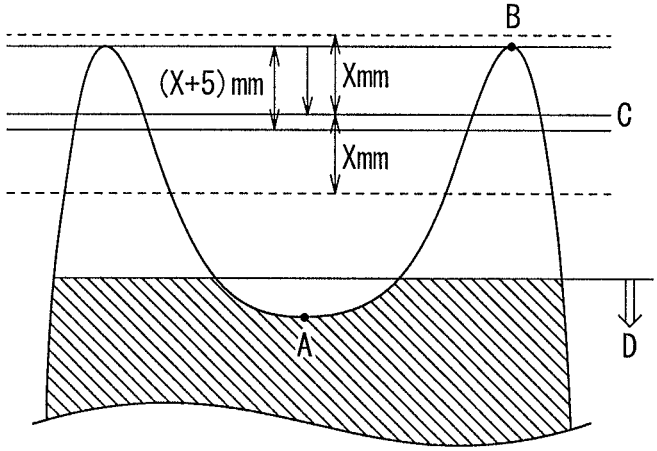

Furthermore, in a case where a distance between the desired cutting location and the convex portion top of the fishtail shape is X (mm) or less as illustrated in FIGS. 6A and 6B, when the location at which the blade of the crop cutting machine actually comes in contact with the sheet bar shifts as much as X (mm) from the desired cutting location toward the convex portion top, there is the possibility that the blade swings uselessly. Consequently, it is preferable that a margin to prevent the useless swinging is set to 5 mm and that the desired cutting location is set to a location on the concave portion bottom side of a location of (X+5) mm from the convex portion top toward the concave portion bottom of the fishtail shape.

Figure 7:
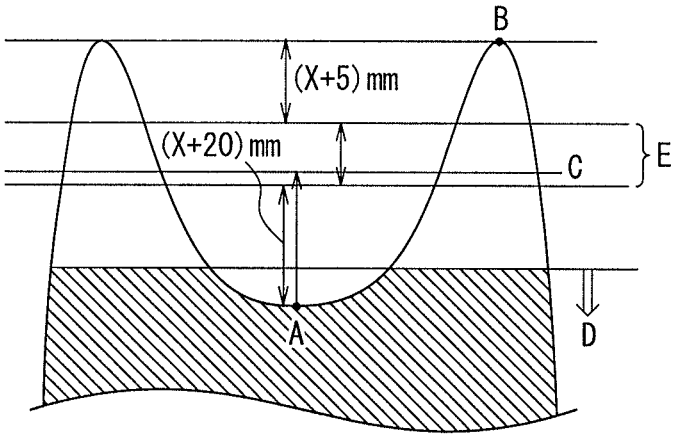
FIG. 7 is a schematic view illustrative of the setting range of the desired cutting location.

From the above, when the intermediate portion between the concave portion bottom and the convex portion top of the fishtail shape of the crop portion formed in the sheet bar is cut, for the purpose of cutting the intermediate portion without being in excess of the cutting load upper limit value of the crop cutting machine and without swinging the blade uselessly, it is preferable to set the desired cutting location to a portion between the location of (X+20) mm from the concave portion bottom toward the convex portion top of the fishtail shape and the location of (X+5) mm from the convex portion top toward the concave portion bottom of the fishtail shape. FIG. 7 illustrates a preferable range of the intermediate portion between the concave portion bottom and the convex portion top of the fishtail shape, to which the desired cutting location is set. When the desired cutting location is set as described above, the cutting can be performed without being in excess of the cutting load upper limit value of the crop cutting machine and without swinging the blade uselessly, also in a case where the deviation between the desired cutting location and the location at which the blade of the crop cutting machine actually comes in contact with the sheet bar is the maximum deviation X (mm).

Furthermore, for the purpose of adjusting the shape of each of the crop portions formed at the front end and the rear end of the sheet bar in the conveying direction into the fishtail shape that satisfies Equation (1) mentioned above, the width rolling amount of the width rolling machine and the width pressing amount of the sizing press have to be changed from conventional conditions. In a conventional operation, a location to cut each of the crop portions at the front end and the rear end of the sheet bar in the conveying direction has been defined as the steady deformed portion of the sheet bar, and the sheet bar has been cut along its total width. Consequently, a crop length has been decreased to decrease a cutting amount, thereby improving yield. That is, the width rolling amount of the width rolling machine and the width pressing amount of the sizing press have been set to decrease the length from the concave portion bottom to the convex portion top of the fishtail shape of each of the crop portions formed at the front end and the rear end of the sheet bar in the conveying direction. On the other hand, for the purpose of cutting the intermediate portion between the concave portion bottom and the convex portion top of the fishtail shape of each of the crop portions formed at the front end and the rear end of the sheet bar in the conveying direction, it is necessary to increase the length from the concave portion bottom to the convex portion top of the fishtail shape, and it is necessary to change the conventional conditions of the width rolling and the sizing press.

In each path of horizontal rolling in the horizontal rough rolling machine, a shape of each of a front end and a rear end of a material to be rolled in a conveying direction on an outlet side of the horizontal rough rolling machine is a composited shape of a shape in which each region of the material to be rolled in a width direction is elongated in a rolling direction substantially in proportion to a reduction ratio by the horizontal rolling and a one-side reduced shape of each width end portion which is generated due to width spread by the horizontal rolling. In the rough rolling step in which a slab having a thickness of 220 to 300 mm and a width of 1200 to 2100 mm targeted in the present invention is rolled into a sheet bar having a sheet thickness of 50 to 100 mm and a sheet width of 1200 to 2100 mm, the shape in which each region of the material to be rolled in the width direction is elongated in the rolling direction substantially in proportion to the reduction ratio by the horizontal rolling can approximately be adjusted into the shape of each of the front end and the rear end of the sheet bar in the conveying direction. Furthermore, the length of the fishtail shape of each of the crop portions formed at the front end and the rear end of the sheet bar in the conveying direction also changes with a cumulative reduction amount of the horizontal rolling by the horizontal rough rolling machine, but the cumulative reduction amount targeted in the present invention is from 55 to 83%, and hence it is defined that in a method which will now be described, a change amount of the fishtail length due to the cumulative reduction amount can be absorbed.

To increase the length from the concave portion bottom to the convex portion top of the fishtail shape of each of the crop portions formed at the front end and the rear end of the sheet bar in the conveying direction by use of the width rolling machine, the width rolling amount of each path is increased. In the width rolling, each width end portion of the material to be rolled (the slab) is only deformed, and hence when the width rolling amount is increased, the thickness of the sheet bar increases as much as the thickness of the width end portion of the slab prior to the horizontal rolling to be performed with the horizontal rough rolling machine. As a result, there increases the length from the concave portion bottom to the convex portion top of the fishtail shape of each of the crop portions formed at the front end and the rear end of the sheet bar in the conveying direction. In a conventional rough rolling step, the width rolling has been performed so that a difference between a sheet width of the sheet bar on an inlet side of the width rolling machine and a sheet width of the horizontally rolled sheet bar is 10 mm or less. However, for the purpose of securely cutting the intermediate portion between the concave portion bottom and the convex portion top of the fishtail shape of each of the crop portions formed at the front end and the rear end of the sheet bar in the conveying direction, it is necessary to set the shortest length L (mm) from the concave portion bottom to the convex portion top of the fishtail shape to (2X+30) mm or more. For this purpose, it is preferable that a width rolling amount $W_R$ by the width rolling machine is 30 mm or more. Furthermore, for the purpose of setting the length of the fishtail shape to 300 mm or less, it is preferable that the width rolling amount $W_R$ is 50 mm or less.

Furthermore, for the purpose of setting the shortest length L from the concave portion bottom to the convex portion top of the fishtail shape to be (2X+30) mm or more and 300 mm or less, it is preferable that width reduction by the sizing press is performed prior to the width rolling by the width rolling machine.

To control the length from the concave portion bottom to the convex portion top of the fishtail shape of each of the crop portions formed at the front end and the rear end of the sheet bar in the conveying direction by use of the sizing press, it is preferable that a width pressing amount $W_P$ (mm) is from 150 mm to 250 mm. When the width pressing amount is smaller than 150 mm, the width end portion of the slab is only deformed by the width reduction to increase the thickness of the width end portion, and hence together with increase of the width pressing amount, there increases the length from the concave portion bottom to the convex portion top of the fishtail shape of each of the crop portions formed at the front end and the rear end of the sheet bar horizontally rolled by the subsequent horizontal rough rolling in the conveying direction. On the other hand, when the width pressing amount is in excess of 250 mm, a slab width central portion is also deformed by the width reduction, and hence a thickness of the slab width central portion increases. This thickened slab width central portion is stretched in the rolling direction by the horizontal rolling of the horizontal rough rolling machine after the width reduction is performed with the sizing press, and hence there decreases the length from the concave portion bottom to the convex portion top of the fishtail shape of each of the crop portions formed at the front end and the rear end of the sheet bar in the conveying direction. When the width pressing amount $W_P$ is from 150 to 250 mm, the thickness of the width end portion of the slab increases, but when the width pressing amount $W_P$ is 200 mm or more, the thickness of the slab width central portion also increases. Consequently, the length from the concave portion bottom to the convex portion top of the fishtail shape increases as the width pressing amount increases until the width pressing amount $W_P$ reaches 200 mm, and when the width pressing amount $W_P$ is 200 mm or more, the length decreases as the width pressing amount increases. Therefore, for the purpose of obtaining a desirable fishtail length, it is preferable that the width pressing amount $W_P$ is 150 mm or more and 250 mm or less and the width rolling amount $W_R$ is 10 mm or more and smaller than 40 mm.

On the other hand, when the width pressing amount $W_P$ is smaller than 150 mm (0 mm is not included) or is in excess of 250 mm and 400 mm or less, there decreases the length from the concave portion bottom to the convex portion top of the fishtail shape formed by the horizontal rolling of the horizontal rough rolling machine after the width reduction is performed with the sizing press, and hence it is preferable that the width rolling amount $W_R$ is from 30 to 50 mm in the same manner as in a case where the width reduction is not performed.

As described above, examples of a method of controlling the length from the concave portion bottom to the convex portion top of the fishtail shape of each of the crop portions formed at the front end and the rear end of the sheet bar in the conveying direction include a method using the width rolling machine and a method using the sizing press in addition to the width rolling machine. Furthermore, by setting the width rolling amount $W_R$ and the width pressing amount $W_P$ in the above-mentioned limited ranges, the sheet bar can be formed so that the shortest length L (mm) from the concave portion bottom to the convex portion top of the fishtail shape is (2X+30) mm or more and 300 mm or less.

The fishtail shape of each of the crop portions formed at the front end and the rear end of the sheet bar subjected to the rough rolling step in the conveying direction is measured with a shape meter disposed before the crop cutting machine. The length from the concave portion bottom to the convex portion top of the fishtail shape is confirmed with the shape meter.

Furthermore, in place of the above shape meter, the shape may visually be confirmed by an operator or another means may be used as long as the shape of the fishtail can be judged.

EXAMPLES

For sheet bars to manufacture hot-rolled steel sheets for line pipe materials (a sheet thickness: 60 mm, a sheet width: 1500 mm, and a finish rolling machine inlet side temperature: 900° C.)', manufacturing conditions of a rough rolling step were changed to prepare the sheet bars having crop portions of various fishtail shapes, and there was measured a cutting load when each of the crop portions of the fishtail shapes at front ends and rear ends of the sheet bars in a conveying direction was cut with a crop cutting machine. A fatigue limit load of the crop cutting machine was 6.47 MN, and hence it was judged that the cutting was impossible in a case where the cutting load of 6.47 MN or more was applied. Furthermore, in a case where a fishtail length was 300 mm or more, cutting was possible, but yield deteriorated, and hence the case was defined as a comparative example.

Table 3 illustrates cutting loads in cases (Nos. 21 to 32) where a crop portion of a fishtail shape was targeted and cut with a crop cutting machine in which a maximum deviation X of a cutting location was 90 mm. No. 21 to 23 are examples to each of which width rolling by a width rolling machine was only applied and Nos. 24 to 32 are examples to each of which width reduction by a sizing press and width rolling by a width rolling machine were both applied. A column of "cuttability" illustrates, as "x", the case that a cutting load of the crop cutting machine was not less than the above fatigue limit load (6.47 MN) and the case that a blade was swung uselessly and hence it was not possible to cut the crop portion, and the column illustrates, as "o", a case where it was possible to cut the crop portion without any troubles. Furthermore, in a case where a fishtail length was in excess of 300 mm, yield deteriorated, and a column of "yield" illustrates this case as "x".

As apparent from Table 3, the present invention examples were evaluated as "o" in both the cutting and the yield, and it was possible to confirm that a manufacturing method of the present invention was effective.

Furthermore, in the present invention examples, it has been confirmed that troubles of sheet passing during finish rolling, e.g., meandering, biting defects, squeezing and bends are not generated and it is possible to stabilize the sheet passing through a finish rolling machine by a crop portion cutting method of the present invention.

TABLE 3

| Sheet bar No. | Cut portion | Width pressing amount [mm] | Width rolling amount [mm] | Fishtail length [mm] | Desired cutting location* [mm] | Actual cutting location* [mm] | Cutting load [MN] | Cuttability | Yield | Remarks |
|---|---|---|---|---|---|---|---|---|---|---|
| 21 | Front end | Unused | 10 | 70 | 43 | 7 | 7.91 | x | o | Comparative |
| | Rear end | | | 110 | 53 | 10 | 7.82 | x | o | example |
| 22 | Front end | Unused | 40 | 250 | 133 | 119 | 4.10 | o | o | Present invention |
| | Rear end | | | 270 | 143 | 86 | 5.34 | o | o | example |
| 23 | Front end | Unused | 55 | 310 | 163 | 75 | 5.94 | o | x | Comparative |
| | Rear end | | | 340 | 178 | 110 | 5.30 | o | x | example |
| 24 | Front end | 100 | 10 | 80 | 48 | 100 | — | x (useless swinging) | o | Comparative |
| | Rear end | | | 90 | 53 | −22 | 7.75 | x | o | example |
| 25 | Front end | 100 | 40 | 260 | 138 | 55 | 6.17 | o | o | Present invention |
| | Rear end | | | 270 | 143 | 67 | 5.89 | o | o | example |
| 26 | Front end | 100 | 55 | 320 | 168 | 140 | 4.40 | o | x | Comparative |
| | Rear end | | | 360 | 188 | 146 | 4.65 | o | x | example |
| 27 | Front end | 200 | 5 | 80 | 48 | −37 | 7.77 | x | o | Comparative |
| | Rear end | | | 110 | 63 | 7 | 7.95 | x | o | example |
| 28 | Front end | 200 | 20 | 290 | 153 | 123 | 4.51 | o | o | Present invention |
| | Rear end | | | 310 | 163 | 126 | 4.65 | o | x | example |
| 29 | Front end | 200 | 50 | 350 | 183 | 179 | 3.83 | o | x | Comparative |
| | Rear end | | | 370 | 193 | 142 | 4.82 | o | x | example |
| 30 | Front end | 300 | 10 | 70 | 43 | 15 | 7.85 | x | o | Comparative |
| | Rear end | | | 90 | 53 | 36 | 7.94 | x | o | example |
| 31 | Front end | 300 | 40 | 270 | 143 | 92 | 5.16 | o | o | Present invention |
| | Rear end | | | 280 | 148 | 116 | 4.59 | o | o | example |
| 32 | Front end | 300 | 55 | 310 | 163 | 87 | 5.63 | o | x | Comparative |
| | Rear end | | | 320 | 168 | 84 | 5.77 | o | x | example |

Figure 8:
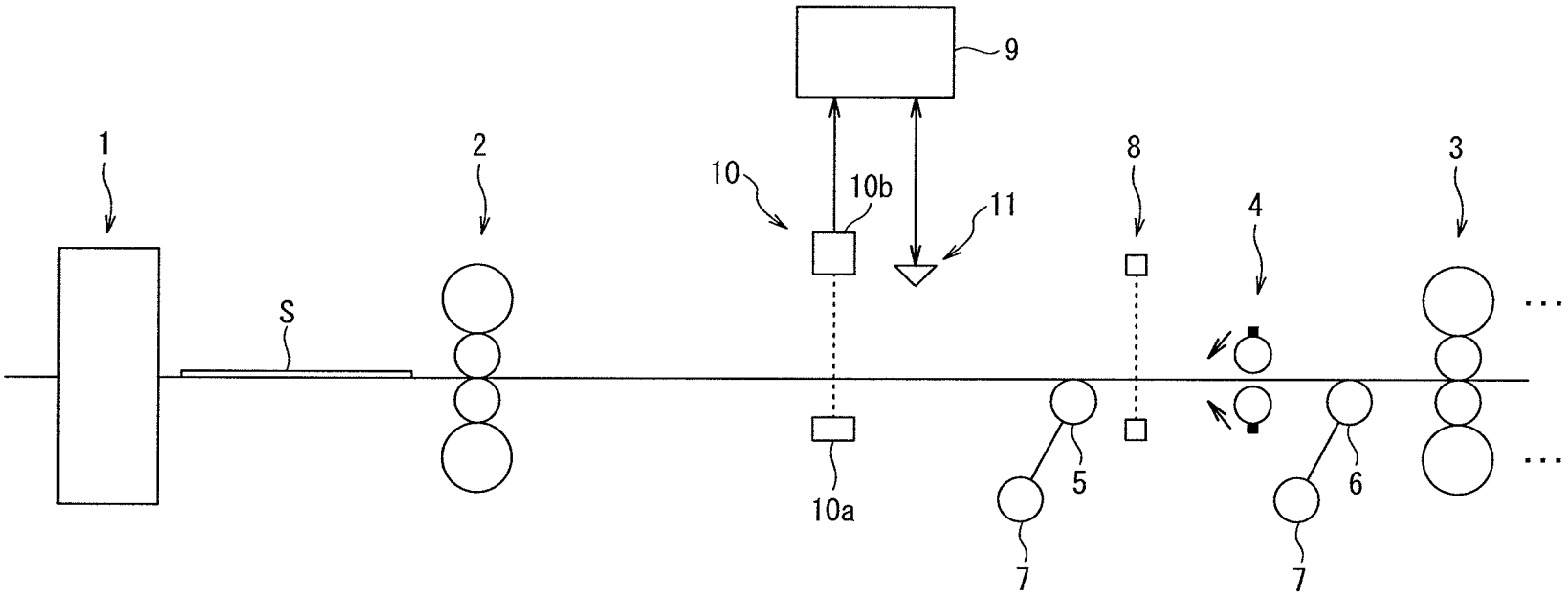
FIG. 8 is a schematic constitutional view illustrative of one embodiment of a hot rolling equipment to which a steel sheet cutting location setting device, a steel sheet cutting location setting method and a steel sheet manufacturing method of the present invention are applied.

*Distance from the concave portion bottom toward the convex portion top of the fishtail Hereinafter, a steel sheet cutting location setting device, a steel sheet cutting location setting method and a steel sheet manufacturing method according to an embodiment of the present invention will be described with reference to the drawings. The steel sheet cutting location setting device, the steel sheet cutting location setting method and the steel sheet manufacturing method of this embodiment are for use in, for example, a hot rolling equipment illustrated in FIG. 8. The hot rolling equipment illustrated in FIG. 8 is a line for manufacturing a hot-rolled steel sheet, and a steel sheet S is, in principle, conveyed (passed) from the left to the right of the drawing except for a case where the steel sheet is reciprocatedly rolled with a rolling machine. The steel sheet (a slab) heated in an unillustrated heating furnace is width-rolled in a width rolling machine 1 and roughly rolled in a rough rolling machine 2. In the width rolling machine 1, the steel sheet is rolled in a width direction, i.e., an orthogonal direction to a conveying direction, and a horizontal direction. Furthermore, in the rough rolling machine 2, the reciprocating rolling is possible and the steel sheet (an intermediate material) S is rolled into a predetermined sheet thickness in accordance with a preset rolling schedule. It is to be noted that a sizing press is also usable in place of the width rolling machine. Furthermore, the sizing press is usable together with the width rolling machine. Furthermore, a plurality of rough rolling machines 2 may be arranged toward the steel sheet conveying direction to decrease the number of times of the reciprocating rolling.

On a downstream side of the rough rolling machine 2 in the steel sheet conveying direction, a finish rolling machine 3 to perform finish rolling of the steel sheet S is disposed. A plurality of finish rolling machines 3 are arranged toward the steel sheet conveying direction, and in each of the finish rolling machines 3, the steel sheet S is finish-rolled into a predetermined sheet thickness in accordance with the preset rolling schedule. On an upstream side of the finish rolling machines 3 in the steel sheet conveying direction and the downstream side of the rough rolling machine 2 in the steel sheet conveying direction, there is disposed a crop cutting machine (a crop shear) 4 to cut crop portions of a front end of the steel sheet S in the conveying direction and a rear end thereof in the conveying direction. The crop cutting machine 4 of this embodiment is a so-called drum type, but in place of this machine, a so-called crank type or vibrating type is also usable. As described above, the front end of the roughly rolled steel sheet S in the conveying direction and the rear end thereof in the conveying direction are rapidly cooled to harden, and hence when the steel sheet is passed through the finish rolling machine 3 as it is, biting defects of the finish rolling machine 3, squeezing of the steel sheet S and the like are generated. To eliminate such a problem, the crop portions of the front end of the steel sheet in the conveying direction and the rear end thereof in the conveying direction are cut with the crop cutting machine 4.

Via the crop cutting machine 4, on the upstream side in the steel sheet conveying direction, a measuring roller 5 is disposed and on the downstream side in the steel sheet conveying direction, a table roller 6 is disposed, and the respective rollers 5 and 6 are connected to rotation sensors 7 to detect rotating states of the rollers 5 and 6.

Furthermore, between the measuring roller 5 and the crop cutting machine 4, there is interposed a tip end sensor 8 to detect the front end of the steel sheet S in the conveying direction and the rear end thereof in the conveying direction. In the tip end sensor 8, for example, gamma rays emitted from a radiation source are detected to detect a passing state of the steel sheet S, thereby outputting, for example, a signal that turns off when the front end in the conveying direction passes and turns on when the rear end in the conveying direction passes. The tip end sensor 8 is disposed in a central portion of the steel sheet S in the width direction. Further, the output of the tip end sensor 8 and the outputs of the rotation sensors 7 are read by an arithmetic processing unit 9 such as a processing computer having a high arithmetic processing ability, and, for example, when the steel sheet S passes through the measuring roller 5, the front end of the steel sheet in the conveying direction is detected, and when the steel sheet S passes through the table roller 6, a length of the steel sheet S at the rear end of the steel sheet in the conveying direction is detected. Furthermore, when the front end of the steel sheet S in the conveying direction is detected by the tip end sensor 8, tracking of the steel sheet S is performed by using the output of the rotation sensor 7, and as described later, each of the crop portions at the front end of the steel sheet S in the conveying direction and the rear end thereof in the conveying direction is cut at a set location with the crop cutting machine 4.

Between the rough rolling machine 2 and the measuring roller 5, there are arranged a crop shape meter 10 that detects a shape of each of the crop portions of the front end of the steel sheet S in the conveying direction and the rear end thereof in the conveying direction, and a plane thermometer (a crop thermometer) 11 that detects a temperature distribution of the crop portion. The crop shape meter 10 is constituted of a lower light source 10*a* disposed under a conveying line of the steel sheet S to emit light upward, and a plurality of cameras 10*b* which are arranged above the lower light source to image a shape of the steel sheet S, and the crop portion reflected with the light from the lower light source 10*a* is imaged with the cameras (digital cameras) 10*b* to detect the shape of the crop portion from the image. Therefore, in the crop shape meter 10, it is possible to detect not only the shape of the crop portion but also edges of both end portions of the steel sheet Sin the width direction. The plane thermometer 11 is constituted of, for example, a scanning type radiation thermometer, a near infrared camera or the like, to detect a temperature distribution of an upper surface of the crop portion, especially the temperature distribution to the steel sheet conveying direction in this embodiment. For the temperature distribution in the crop portion to the steel sheet conveying direction, for example, an average value of temperatures of the steel sheet S in the width direction is obtained every preset length of the steel sheet in the conveying direction, and the values are arranged in the steel sheet conveying direction to obtain the temperature distribution in the crop portion to the steel sheet conveying direction. In the plane thermometer 11, it is also possible to detect a maximum temperature in the crop portion every preset length of the steel sheet in the conveying direction. Further, an output of the crop shape meter 10 and an output of the plane thermometer 11 are read by the arithmetic processing unit 9, to set a cutting location of the crop portion in accordance with arithmetic processing which will be described later.

Figure 9A:
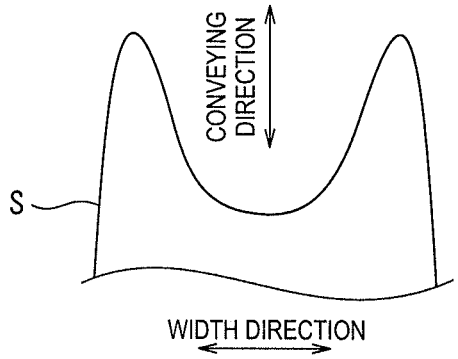
FIGS. 9A and 9B are explanatory views of the crop portion formed at the front end of the steel sheet in the conveying direction or the rear end thereof in the conveying direction.
Figure 9B:
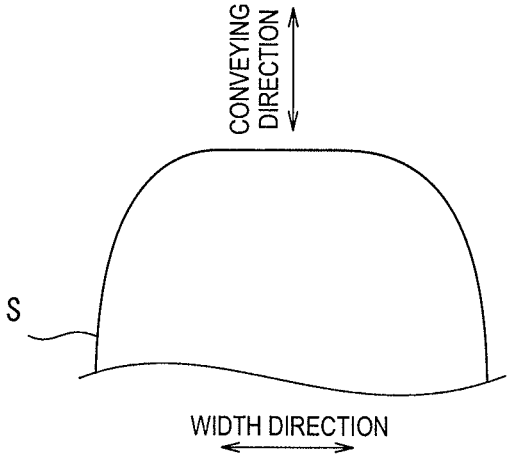

In the line for manufacturing the hot-rolled steel sheet of this embodiment, in addition to usual materials, the above-mentioned hot-rolled steel sheets for line pipe materials are manufactured. The hot-rolled steel sheet for the line pipe material has a larger sheet width, a larger sheet thickness and a lower temperature than the usual material, and hence there is the fear that a cutting load of each of the crop portions of the front end in the conveying direction and the rear end in the conveying direction increases and is in excess of a cutting load upper limit value of the existing crop cutting machine 4. The crop portions formed at the front end of the steel sheet S in the conveying direction and the rear end thereof in the conveying direction are roughly divided into a fishtail shape illustrated in FIG. 9A and a tongue shape illustrated in FIG. 9B. In the fishtail shape, both the end portions of the steel sheet S in the width direction project in the conveying direction more than the central portion of the steel sheet in the width direction. In the tongue shape, the central portion of the steel sheet S in the width direction projects in the conveying direction more than both the end portions in the width direction. It can be considered that the cutting load of the crop portion by the crop cutting machine 4 is proportional to a cutting area, and hence in this embodiment, the crop portion is formed into the fishtail shape and is cut at its intermediate location. To form the crop portion into the fishtail shape, prior to rough rolling, width rolling or width reduction of the steel sheet S may be performed with the width rolling machine 1 or the sizing press so that a sheet thickness of each end portion of the steel sheet S in the width direction is larger than a sheet thickness of the central portion thereof in the width direction. It is to be noted that an intermediate location of the crop portion of the fishtail shape indicates the location between a concave portion bottom and a convex portion top of the fishtail shape.

Figure 10:
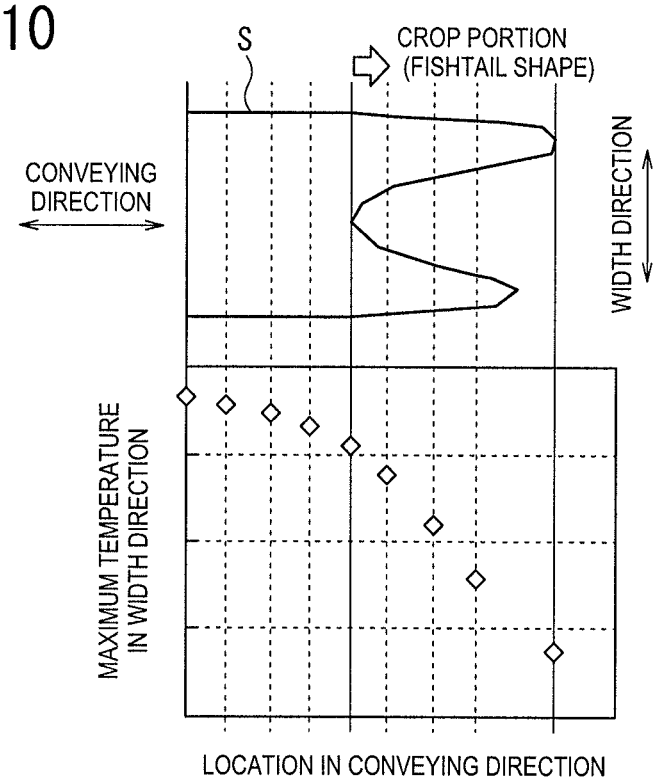
FIG. 10 is an explanatory view of a temperature distribution in the crop portion of a fishtail shape to the steel sheet conveying direction.

First, a crop cutting location set in specifications of the hot-rolled steel sheet for the line pipe material will be described. FIG. 10 illustrates, for example, the fishtail shape of the crop portion of the hot-rolled steel sheet for the line pipe material at the location of the crop cutting machine 4 and a maximum temperature distribution of the crop portion to the steel sheet conveying direction. A temperature of the steel sheet S that is heated and then roughly rolled lowers closer to the convex portion top of the crop portion of the fishtail shape, and the convex portion top is thus harder. On the other hand, at a location corresponding to the concave portion bottom of the crop portion of the fishtail shape, the maximum temperature is high, but the concave portion bottom of the crop portion itself also has a large amount of heat to be released and is thus harder. Furthermore, the cutting area at the location of the concave portion bottom of the crop portion of the fishtail shape is also large, and hence in the hot-rolled steel sheet for the line pipe material, there is the high possibility that, in a region of a preset length of, e.g., 20 mm from the concave portion bottom toward the convex portion top of the crop portion, the cutting load is in excess of the cutting load upper limit value of the crop cutting machine 4, and the region is inappropriate as the cutting location of the crop portion. An amount of the steel sheet cutting location to be regulated which is set in the specifications of the hot-rolled steel sheet for the line pipe material is defined as an amount of the crop shape to be regulated.

Next, a crop cutting location set in specifications of the existing line for manufacturing the hot-rolled steel sheet will be described. In a case where the crop portion is cut with the crop cutting machine 4, a deviation between a desired cutting location and a location at which the crop portion is actually cut depends on tracking accuracy of the steel sheet S. This tracking accuracy of the steel sheet S is determined by the specifications of the existing line for manufacturing the hot-rolled steel sheet, and when the desired cutting location is not set to a location on an inner side as much as this cutting location deviation due to the tracking accuracy from the intermediate location between the concave portion bottom and the convex portion top of the crop portion of the fishtail shape, the crop portion of the fishtail shape cannot be cut at the intermediate location. To eliminate such a problem, in this embodiment, there is set, as a convex portion side cutting location, a location of a length of the cutting location deviation due to the tracking accuracy, i.e., a location of a preset length in the steel sheet conveying direction, e.g., a location of 90 mm from the convex portion top toward the concave portion bottom of the crop portion of the fishtail shape of the hot-rolled steel sheet for the line pipe material. Furthermore, there is calculated, as a first cutting location, a location of the length (=90 mm) of the cutting location deviation due to the tracking accuracy in addition to the above-mentioned amount (=20 mm) of the crop shape to be regulated, i.e., the location of the preset length in the steel sheet conveying direction in which both of the amount and the length are added up, e.g., the location of 110 mm from the concave portion bottom toward the convex portion top of the crop portion of the fishtail shape of the hot-rolled steel sheet for the line pipe material.

On the other hand, as described above, it can be considered that the cutting area of the crop portion of the fishtail shape decreases gradually from the concave portion bottom toward the convex portion top and hence the cutting load also decreases, but the temperature lowers gradually from the concave portion bottom toward the convex portion top and hence the hardness also increases, and as a result, the cutting load increases from the concave portion bottom toward the convex portion top depending on the temperature.

Substantially, from the concave portion bottom toward the convex portion top of the crop portion of the fishtail shape, a decrease ratio of the cutting load due to the cutting area is larger than an increase ratio of the cutting load due to the temperature, and hence the cutting load decreases closer to the convex portion top of the crop portion. To eliminate such a problem, in the hot-rolled steel sheet for the line pipe material, the cutting load in the crop portion is calculated by taking the cutting area of the crop portion of the fishtail shape, i.e., the shape of the crop portion into consideration in addition to the temperature distribution in the crop portion to the steel sheet conveying direction which is detected by the plane thermometer 11, and a location at which the cutting load is not more than the cutting load upper limit value of the crop cutting machine 4 is calculated as a second cutting location. The cutting area of the crop portion may be obtained in detail from, for example, a shape of a cutting blade of the crop cutting machine 4, but an actual cutting width from the concave portion bottom toward the convex portion top of the crop portion may be substituted. In this embodiment, when calculating the crop cutting load, the cutting width of the crop portion is used.

Further, one the above-mentioned first cutting location and the second cutting location which has a larger distance from the concave portion bottom of the crop portion of the fishtail shape is set as a concave portion side cutting location, and a location between this concave portion side cutting location and the above-mentioned convex portion side cutting location is set as the cutting location of the crop portion. It is to be noted that in a case where the first cutting location is set to a location that is distant from the concave portion bottom of the crop portion of the fishtail shape more than the convex portion side cutting location, when the crop portion is cut at the convex portion side cutting location, the cutting load is in excess of the cutting load upper limit value of the crop cutting machine 4, and when the crop portion is cut at the first cutting location, there is the possibility that the crop portion cannot be cut at the intermediate location of the crop portion. Therefore, according to this embodiment, in one of two convex portions in the crop portion of the fishtail shape which has a smaller length from the concave portion bottom to the convex portion top, the length from the concave portion bottom to the convex portion top is set to be 200 mm or more and preferably 300 mm or less.

Figure 11:
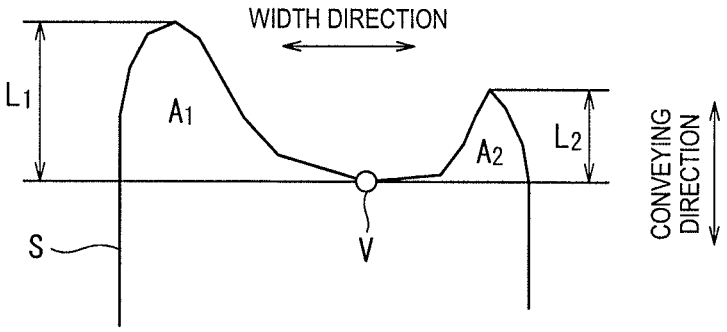
FIG. 11 is an explanatory view of the crop portion of the fishtail shape.

Prior to the arithmetic processing to be performed in the arithmetic processing unit 9 to set the cutting location of the crop portion of the steel sheet S in this manner, the concave portion bottom and the convex portion top of the crop portion of the fishtail shape will be described. The two convex portions of the crop portion of the fishtail shape formed at each of the front end of the steel sheet S in the conveying direction and the rear end thereof in the conveying direction are not necessarily equal to each other. Instead, there are more cases where two convex portions of the crop portion of the fishtail shape are not equal to each other. Furthermore, there is also a case where the shape of the crop portion is the tongue shape. Consequently, as illustrated in FIG. 11, in the shape of the steel sheet S which is detected by the crop shape meter 10, the edges of both the end portions of the steel sheet S in the width direction are detected from the central portion of the steel sheet S in a longitudinal direction, i.e., the central portion in the conveying direction, and a point V immediately after the number of the edges become three is defined as the concave portion bottom. Next, areas A1 and A2 of convex portions on both sides of the concave portion bottom V that is detected by the crop shape meter 10 are calculated and further, distances L1 and L2 from the respective convex portion tops to the concave portion bottom are calculated, respectively. In this arithmetic process, in a case where the number of the edges does not become three and the concave portion bottom is not present, a case where a ratio of the area A1 of the convex portion having the larger area to the area A2 of the convex portion having the smaller area in the two convex portions is not less than a preset stipulated value, and a case where each of the distances L1 and L2 from the convex portion tops of the two convex portions to the concave portion bottom is not more than the preset stipulated value, it is judged that the crop portion has the tongue shape (or does not have the fishtail shape). On the other hand, in cases other than these cases, it is judged that the crop portion has the fishtail shape, and hence the top of the convex portion having the smaller area in the two convex portions is defined as the convex portion top. This is because in the case where the top of the convex portion having the larger area is defined as the convex portion top in crop portion cutting location setting which will be described later, there is the possibility that the convex portion having the smaller area cannot be cut.

Figure 12:
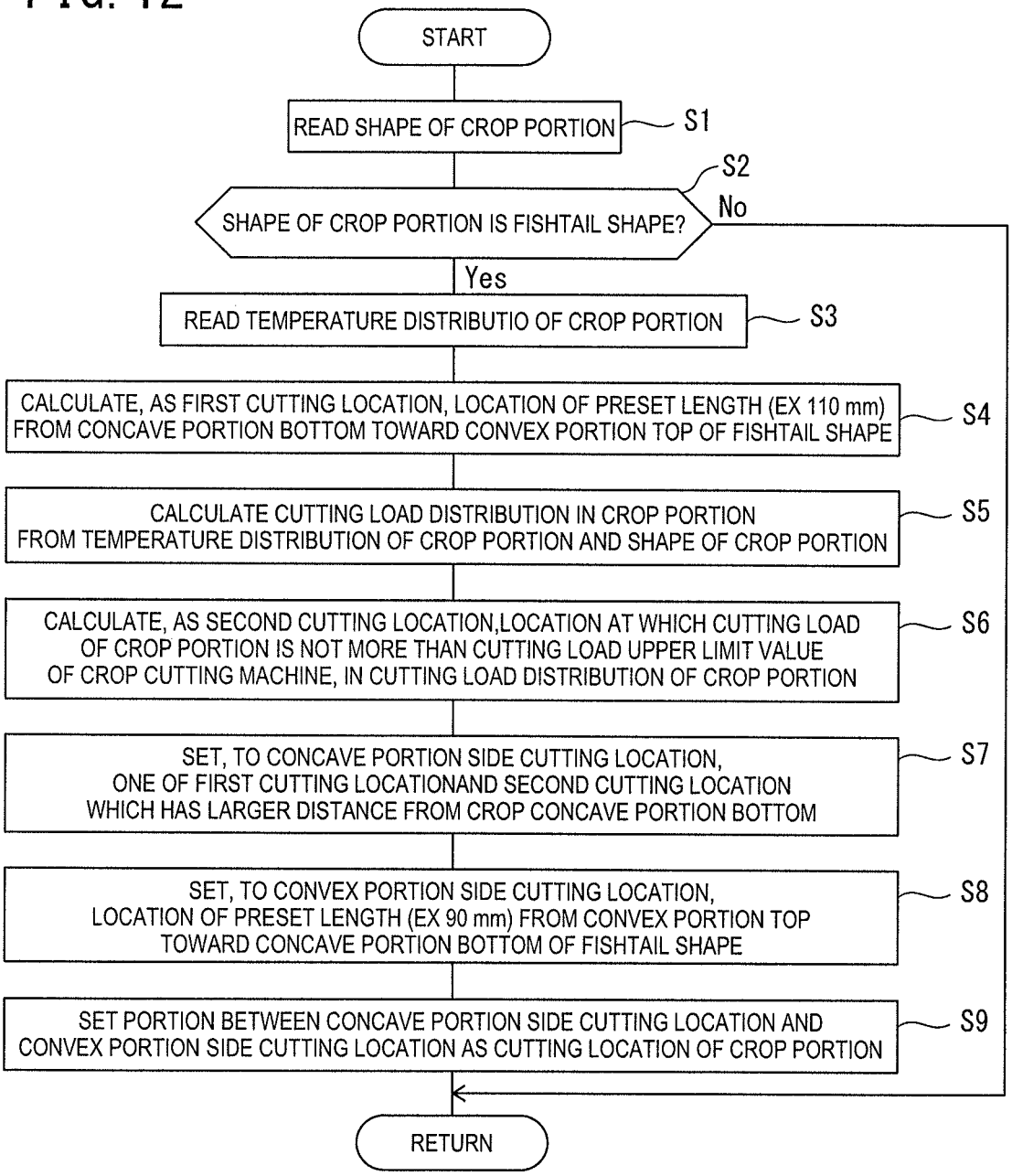
FIG. 12 is a flowchart of arithmetic processing to be performed in an arithmetic processing unit of FIG. 8.

Next, the arithmetic processing for the cutting location setting of the crop portion of the steel sheet S which is performed in the arithmetic processing unit 9 will be described with reference to a flowchart of FIG. 12. This arithmetic processing is started, for example, simultaneously when the front end of the hot-rolled steel sheet S for the line pipe material in the conveying direction is detected by the measuring roller 5, and first in step S1, the shape of the crop portion which is detected by the crop shape meter 10 is read.

Next, the processing advances to step S2, to judge whether or not the read shape of the crop portion is the fishtail shape, and in a case where the shape of the crop portion is the fishtail shape, the processing advances to step S3, and in another case, the processing returns.

In the step S3, the temperature distribution of the crop portion which is detected by the plane thermometer 11 is read.

Next, the processing advances to step S4, and the location of the preset length (e.g., 110 mm) from the concave portion bottom toward the convex portion top of the crop portion of the fishtail shape in the steel sheet conveying direction is calculated as the first cutting location.

Next, the processing advances to step S5, and a cutting load distribution in the crop portion is calculated from the read temperature distribution of the crop portion and the read shape of the crop portion.

Next, the processing advances to step S6, and the location at which the cutting load of the crop portion is not more than the cutting load upper limit value of the crop cutting machine 4 is calculated as the second cutting location, in the calculated cutting load distribution in the crop portion.

Next, the processing advances to step S7, and one of the calculated first cutting location and the calculated second cutting location which has the larger distance from the concave portion bottom of the crop portion is set to the concave portion side cutting location.

Next, the processing advances to step S8, and the convex portion side cutting location the location of the preset length (e.g., 90 mm) from the convex portion top toward the concave portion bottom of the crop portion of the fishtail shape in the steel sheet conveying direction is set to the concave portion side cutting location.

Next, the processing advances to step S9, to set a portion between the set concave portion side cutting location and the set convex portion side cutting location as the cutting location of the crop portion, and then returns.

According to this arithmetic processing, in the read shape of the crop portion of the hot-rolled steel sheet for the line pipe material, the location of the preset length from the concave portion bottom toward the convex portion top of the fishtail shape in the steel sheet conveying direction is calculated as the first cutting location, the cutting load distribution in the crop portion to the steel sheet conveying direction is calculated from the read temperature distribution of the crop portion and the read shape of the crop portion, and in the calculated cutting load distribution in the crop portion to the steel sheet conveying direction, the location at which the cutting load of the crop portion is not more than the cutting load upper limit value of the crop cutting machine 4 is calculated as the second cutting location. Further, one of the calculated first cutting location and the calculated second cutting location which has the larger distance from the concave portion bottom of the fishtail shape is set as the concave portion side cutting location at which the crop portion is cuttable. Furthermore, in the read shape of the crop portion, the location of the preset length from the convex portion top toward the concave portion bottom of the fishtail shape in the steel sheet conveying direction is set as the convex portion side cutting location at which the crop portion is cuttable, and the portion between the concave portion side cutting location and the concave portion side cutting location is set as the above cutting location of the crop portion.

Figure 13A:
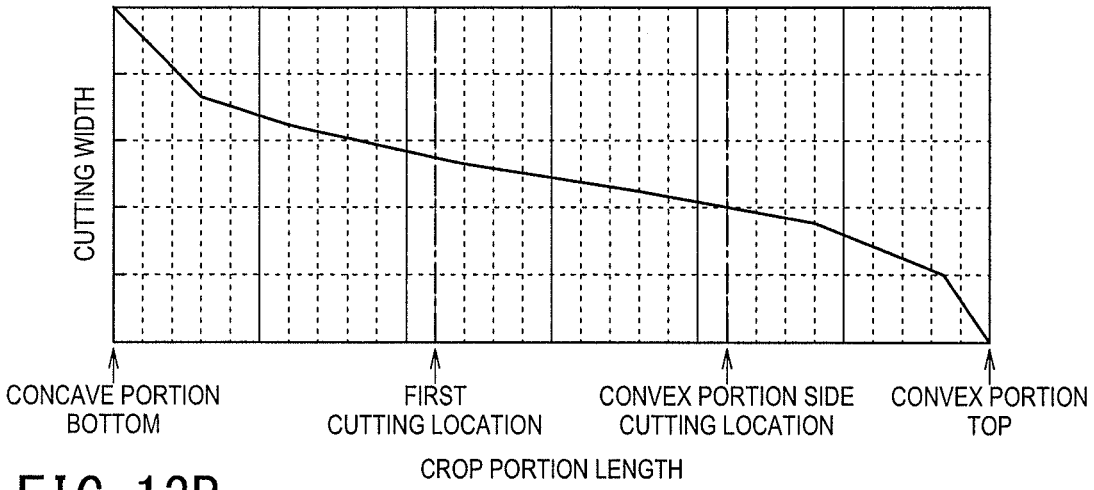
FIGS. 13A to 13C are explanatory views of an operation of the arithmetic processing of FIG. 12.
Figure 13B:
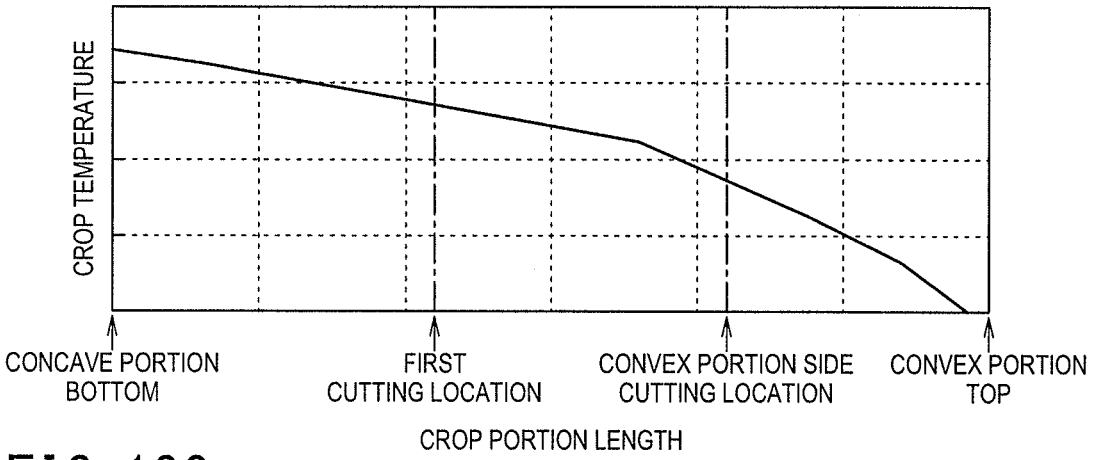
Figure 13C:
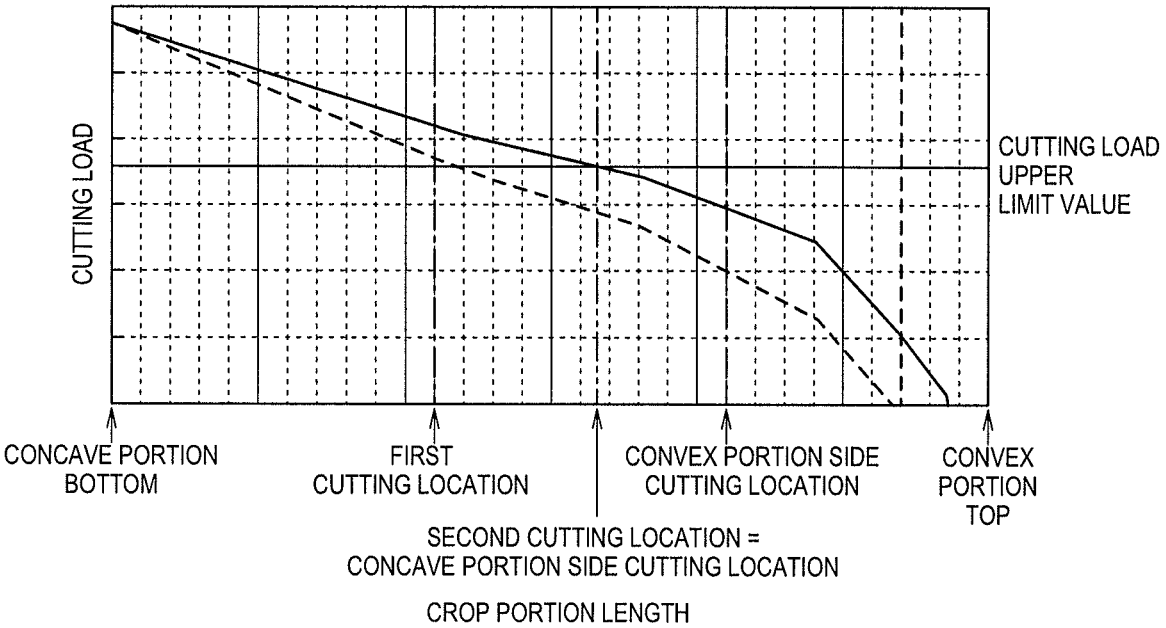

For example, in a case where a width of the convex portion of the crop portion which is detected by the crop shape meter 10, i.e., the cutting width when the crop portion is cut with the crop cutting machine 4 is such a width as illustrated in FIG. 13A, the first cutting location and the convex portion side cutting location which are determined by the shape of the crop portion of the hot-rolled steel sheet for the line pipe material are illustrated by one-dot chain lines in the drawing, respectively. On the other hand, in a case where the temperature distribution of the crop portion which is detected by the plane thermometer 11 is such a distribution as illustrated in FIG. 13B, the cutting load distribution of the crop portion which is determined by its temperature distribution and the shape of the crop portion, i.e., the cutting width is illustrated by a solid line of FIG. 13C. This cutting load of the crop portion is not more than the cutting load upper limit value of the crop cutting machine 4 at the second cutting location, and hence the second cutting location is illustrated by a two-dot chain line in FIG. 13C. This second cutting location has a larger distance from the concave portion bottom than the first cutting location, and hence the second cutting location is set to the concave portion side cutting location. When the cutting load distribution of the crop portion is obtained without considering the temperature distribution of the crop portion and only by considering the cutting width of the crop portion, the distribution is illustrated by a broken line in FIG. 13C. When the second cutting location is set from the cutting load of the crop portion in which the crop portion shape is only reflected, there is the possibility that the actual cutting load of the crop portion is in excess of the cutting load upper limit value of the crop cutting machine 4.

Figure 14:
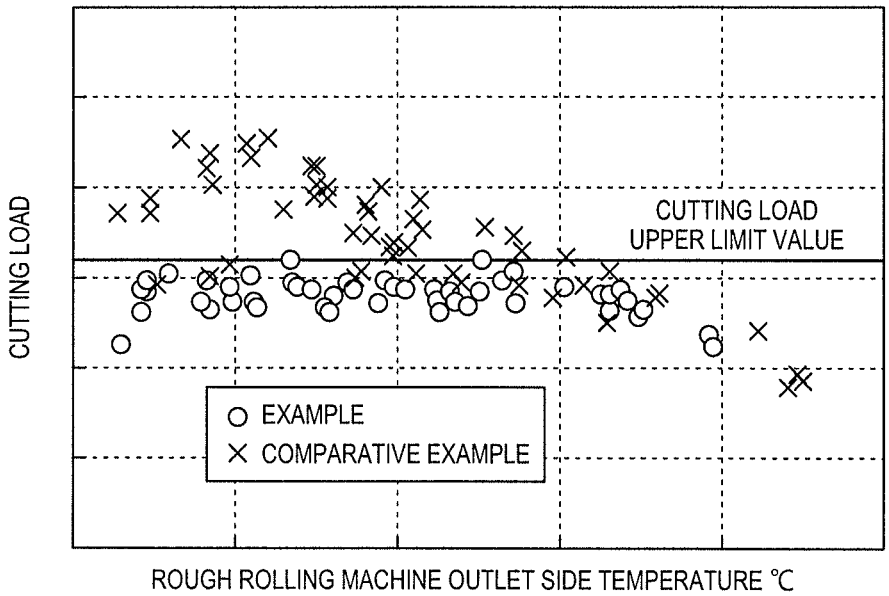
FIG. 14 is an explanatory view of an effect of the arithmetic processing of FIG. 12.

In the existing line for manufacturing the hot-rolled steel sheet, for the intermediate material (a sheet thickness of 65 mm, a sheet width of 1600 mm, and a finish rolling inlet side temperature of 840 to 890° C.) to manufacture the hot-rolled steel sheet for the line pipe material, each of the crop portions of the front end in the conveying direction and the rear end in the conveying direction is formed into the fishtail shape, and the crop portions were cut with the crop cutting machine 4 at the cutting location at which the temperature distribution and the cutting width of the crop portion were reflected and the cutting location at which the cutting width of the crop portion was only reflected, respectively. FIG. 14 illustrates a cutting load of the crop cutting machine 4 at the cutting location by the arithmetic processing of FIG. 12 in which the temperature distribution and the cutting width of the crop portion are reflected as an example by sign o, and FIG. 14 illustrates a cutting load of the crop cutting machine 4 at the cutting location at which the cutting width of the crop portion is only reflected as a comparative example by sign x. A temperature of the abscissa is a temperature on an outlet side of the rough rolling machine 2 at a location of 1 m from the front end in the conveying direction, as a representative temperature of the intermediate material. As apparent from the drawing, the cutting load of the crop cutting machine 4 at the cutting location at which the cutting width of the crop portion is only reflected is in excess of the cutting load upper limit value of the crop cutting machine 4. On the other hand, the cutting load of the crop cutting machine 4 at the cutting location at which the temperature distribution and the cutting width of the crop portion are reflected is not in excess of the cutting load upper limit value of the crop cutting machine 4.

In this way, according to the steel sheet cutting location setting device and its method of this embodiment, when the crop portion formed into the fishtail shape at the front end of the steel sheet in the conveying direction or the rear end thereof in the conveying direction by the rough rolling is cut with the crop cutting machine prior to the finish rolling, the cutting location of the crop portion is set by the arithmetic processing unit 9 having an arithmetic processing function. In this case, the shape of the crop portion which is detected by the crop shape meter 10 is read in the crop portion shape reading step S1, and the temperature distribution of the crop portion which is detected by the plane thermometer 11 is read in the crop portion temperature distribution reading step S3. Furthermore, in the read shape of the crop portion, the location of the preset length from the concave portion bottom toward the convex portion top of the fishtail shape in the steel sheet conveying direction is calculated as the first cutting location in the first cutting location calculating step S4. Furthermore, the cutting load distribution in the crop portion to the steel sheet conveying direction is calculated from the read temperature distribution of the crop portion and the read shape of the crop portion in the cutting load calculating step S5, and in the calculated cutting load distribution in the crop portion to the steel sheet conveying direction, the location at which the cutting load of the crop portion is not more than the cutting load upper limit value of the crop cutting machine 4 is calculated as the second cutting location in the second cutting location calculating step S6. Further, one of the calculated first cutting location and the calculated second cutting location which has the larger distance from the concave portion bottom of the fishtail shape is set as the crop portion side cutting location at which the crop portion is cuttable in the concave portion side cutting location setting step S7. Furthermore, in the read shape of the crop portion, the location of the preset length from the convex portion top toward the concave portion bottom of the fishtail shape in the steel sheet conveying direction is set as the convex portion side cutting location at which the crop portion is cuttable in the convex portion side cutting location setting step S8. Further, the portion between the concave portion side cutting location and the convex portion side cutting location is set as the cutting location of the crop portion in the crop portion cutting location setting step S9. Therefore, even when the steel sheet has a larger sheet thickness, a larger sheet width and a lower temperature, the steel sheet can stably be cut without performing any noticeable equipment modification such as reinforcement of the crop cutting machine 4.

Needless to say, the present invention includes various embodiments and the like which are not described herein. Therefore, a technical scope of the present invention is determined only by invention specifying matters described in a proper scope of patent claim from the above description.

REFERENCE SIGNS LIST

A concave portion bottom
B convex portion top
C desired cutting location
D region of non-cuttable location
E set range of desired cutting location
1 width rolling machine
2 rough rolling machine
3 finish rolling machine
4 crop cutting machine
5 measuring roller
6 table roller
7 rotation sensor
8 tip end sensor
9 arithmetic processing unit
10 crop shape meter
11 plane thermometer (crop thermometer)
S steel sheet

The invention claimed is:

1. A method for manufacturing a hot-rolled steel sheet which comprises a rough rolling step and a finish rolling step and in which after the rough rolling step and before the finish rolling step, a crop portion of a front end of a steel sheet in a conveying direction is cut with a crop cutting machine, and then the steel sheet is finish-rolled in the finish rolling step to manufacture the hot-rolled steel sheet, wherein in the rough rolling step, a shape of the crop portion formed at the front end of the steel sheet in the conveying direction is adjusted into a fishtail shape, in which both ends of the steel sheet in a width direction project in the conveying direction with respect to a central portion of the steel sheet in the width direction, by width rolling of a width rolling machine and horizontal rolling of a horizontal rough rolling machine, the steel sheet is formed so that the shortest length L (mm) from a concave portion bottom to a convex portion top of the fishtail shape satisfies Equation (1) mentioned below, and an intermediate portion between the concave portion bottom and the convex portion top, defined as a desired cutting location, is cut:

$$(2X+30) \leq L \leq 300 \quad (1),$$

in which X is a maximum deviation (mm) of the cutting location of the crop cutting machine and $0 \leq X \leq 90$.

2. The method for manufacturing the hot-rolled steel sheet according claim 1, wherein in the rough rolling step, in addition to the crop portion formed at the front end of the steel sheet in the conveying direction, a shape of a crop portion formed at a rear end of the steel sheet in the conveying direction is adjusted into a fishtail shape that satisfies Equation (1) mentioned above, and an intermediate portion between a concave portion bottom and a convex portion top of the fishtail shape, defined as a desired cutting location, is cut.

3. The method for manufacturing the hot-rolled steel sheet according to claim 1, wherein the desired cutting location is set to a portion between a location of (X+20) mm from the concave portion bottom toward the convex portion top of the fishtail shape and a location of (X+5) mm from the convex portion top toward the concave portion bottom.

4. The method for manufacturing the hot-rolled steel sheet according to claim 1, wherein in the rough rolling step, a width rolling amount $W_R$ (mm) by the width rolling machine is from 30 to 50 mm.

5. The method for manufacturing the hot-rolled steel sheet according to claim 1, wherein in the rough rolling step, the steel sheet is subjected to width reduction by a sizing press prior to the width rolling by the width rolling machine.

6. The method for manufacturing the hot-rolled steel sheet according to claim 5, wherein in the rough rolling step, a width pressing amount $W_P$ (mm) of the sizing press is from 150 to 250 mm and a width rolling amount $W_R$ (mm) by the width rolling machine is 10 mm or more and smaller than 40 mm.

7. The method for manufacturing the hot-rolled steel sheet according to claim 5, wherein in the rough rolling step, a width pressing amount $W_P$ (mm) of the sizing press is smaller than 150 mm or in excess of 250 mm and 400 mm or less and a width rolling amount $W_R$ (mm) by the width rolling machine is from 30 to 50 mm.

* * * * *